US006601302B2

(12) United States Patent
Andrew

(10) Patent No.: US 6,601,302 B2
(45) Date of Patent: Aug. 5, 2003

(54) SHAVING SYSTEMS AND ADJUSTABLE TRIMMERS THEREFOR

(75) Inventor: Michael A. Andrew, Milford, CT (US)

(73) Assignee: Remington Corporation, L.L.C., Bridgeport, CT (US)

( * ) Notice: Subject to any disclaimer, the term of this patent is extended or adjusted under 35 U.S.C. 154(b) by 0 days.

(21) Appl. No.: 09/925,061

(22) Filed: Aug. 8, 2001

(65) Prior Publication Data

US 2002/0078570 A1 Jun. 27, 2002

Related U.S. Application Data

(60) Provisional application No. 60/231,407, filed on Sep. 8, 2000.

(51) Int. Cl.[7] ..... B26B 19/20
(52) U.S. Cl. ..... 30/34.1; 30/43.1; 30/43.9
(58) Field of Search ..... 30/34.1, 43.92, 30/34.05, 43.6, 43.9, 346.51

(56) References Cited

U.S. PATENT DOCUMENTS

| | | | | |
|---|---|---|---|---|
| 4,434,553 A | | 3/1984 | Kness | 30/34.1 |
| 4,845,847 A | | 7/1989 | Yasunaka et al. | 30/34.1 |
| 4,930,217 A | | 6/1990 | Wolf et al. | 30/43.92 |
| 4,941,259 A | | 7/1990 | Wolf | 30/34.1 |
| 5,054,199 A | | 10/1991 | Ogawa et al. | 30/34.1 |
| 5,084,967 A | | 2/1992 | Nakagawa et al. | 30/34.1 |
| 5,386,631 A | | 2/1995 | Van Asten et al. | 30/34.1 |
| 5,423,125 A | | 6/1995 | Wetzel | 30/34.1 |
| 5,507,095 A | * | 4/1996 | Wetzel et al. | 30/34.1 |
| 5,524,345 A | | 6/1996 | Eichhorn | 30/34.1 |
| 6,226,869 B1 | * | 5/2001 | Heintke et al. | 30/34.1 |

* cited by examiner

*Primary Examiner*—Hwei-Siu Payer
(74) *Attorney, Agent, or Firm*—Melvin I. Stoltz

(57) ABSTRACT

By providing a separate and independent hair trimmer or trimming assembly which is incorporated into a shaver system and is controllably movable directly into a variety of alternate positions for providing enhanced cutting of hair fibers, a substantially improved, close and comfortable shaving system is obtained which effectively cuts both short hair and long hair. By employing a single, multi-positionable, switch member which cooperates with a movement control system incorporated into a trimmer assembly, user control is provided for altering the position of the trimmer assembly for placing the trimmer assembly directly and any precisely desired orientation or location. In addition, in the preferred embodiment, the trimmer assembly incorporates a pair of specially constructed cutting elements formed thereon for providing enhanced cutting and/or trimming capabilities in a wide variety of alternate operations.

27 Claims, 40 Drawing Sheets

SHAVING SYSTEMS AND ADJUSTABLE TRIMMERS THEREFOR

RELATED APPLICATIONS

This application is related to U.S. Provisional Patent Application Serial No. 60/231,407, filed Sep. 8,2000 entitled SHAVING SYSTEMS AND ADJUSTABLE TRIMMERS THEREFOR.

TECHNICAL FIELD

This invention relates to electric dry shavers and, more particularly, to improving long hair and short hair cutting systems for shavers.

BACKGROUND ART

Over the last several years, both men and women have been increasingly drawn to the advantages provided by electric dry shavers. In general, the consuming public has found that the use of razors or other systems is extremely inconvenient for removing or shaving long hair and/or short hair or stubble, as commonly found in men's beards and women's legs. In addition, with the ever increasing time constraints and commitments individuals typically encounter, a fast and effective shaving system is most desirable.

The discomfort as well as the time consumed in using shaving creams, soaps and gels, in order to provide a medium for which a razor can be used, requires more time and inconvenience than most individuals are willing or capable of experiencing. Furthermore, the cost of maintaining a sufficient supply of these products creates an additional burden. Consequently, electric dry shavers have become increasingly popular, as well as battery-operated electric dry shavers which can withstand exposure to moisture, thereby enabling individuals to simultaneously shower, as well as shaving their beard or legs.

As the popularity of using electric dry shavers increased, numerous product designs with alternate constructions proliferated, in an attempt to improve and enhance the comfort and cutting efficiency of such shavers. However, in spite of these products, difficulties have continued to exist in providing optimum results with optimum comfort.

One particular shaver construction has been found to be extremely efficacious in achieving high-quality shaving results, as well as being extremely comfortable to use. This configuration comprises the various models of electric dry shavers incorporating a movable cutting blade which cooperates with a thin, flexible mesh screen or apertured foil.

In operation, the cutting blades are rapidly and continuously reciprocally moved past one side of the mesh screen or apertured foil, causing the cutting blades to repeatedly cross the plurality of apertures and provide a virtually continuous cutting action at each aperture. Then, by slidingly guiding the other side of the mesh screen or apertured foil over the skin surface to be shaved, the individual hair shafts enter the holes formed in the screen or foil and are cut by the movement of the cutting blades.

Although this dry shaving cutting system has proven to be extremely effective, as compared to other dry shaving products, one important area of difficulty does exist. This area of difficulty is found in the shaving of longer hair fibers, typically encountered on men's necks and women's legs, and anytime an individual does not shave consistently in regular intervals.

In many instances where the longer hair shafts are encountered, the movement of the mesh screen or apertured foil over the skin surface causes the hair fibers to bend, preventing the terminating end of the hair from entering the mesh screen or apertured foil. As a result, these longer hair fibers are not cut and remain on the skin surface.

In an attempt to eliminate this prior art deficiency, many prior art electric dry shavers incorporate separate hair trimming assemblies which are independently formed on the shaver for being separately activated when necessary. Typically, these hair trimmers have a single OFF position and a single ON position, which enables them to be used separately in specific, limited circumstances. However, these prior art shaver systems are incapable of satisfying the need for having the long hair trimmers actively employed as an integral part of the shaving process.

Although some prior art products have attempted to incorporate trimmers in combination with the cutting foils for being used simultaneously with the shaving action provided by the apertured foil or mesh screen, these systems also suffer from an inability of being usable in all shaving circumstances encountered by the individual. Typically, these trimmers are not movable and are only usable in combination with the apertured foil. Consequently, these prior art systems failed to provide the versatility sought by consumers in an electric dry shaving apparatus.

A further problem found in prior art shavers is the inability of the trimmer to move in a "floating" manner when passed over the skin surface. As a result, an uncomfortable shave is produced after causing unwanted cuts.

Consequently, it is a principal object of the present invention to provide an enhanced electric dry shaver system for use by both men and women for effectively cutting both short hair and long hair in virtually all circumstances encountered by the user.

Another object of the present invention is to provide an enhanced electric dry shaving system having the characteristic features described above which is capable of providing a trimmer having a variety of alternate positions, thereby enabling the trimmer to be employed with an apertured foil cutting system regardless of the operation being performed by the aperture foil.

A further object of the present invention is to provide an enhanced electric dry shaving system having the characteristic features described above which enables the trimmer to be quickly and easily selectively positioned and maintained in any of its alternate positions.

Another object of the present invention is to provide an enhanced electric dry shaving system having the characteristic features described above which provides a shaver capable of being vertically flexed or moved during use, thereby achieving a floating action for enhanced comfort.

Other and more specific objects will in part the obvious and will in part appear hereinafter.

SUMMARY OF THE INVENTION

By employing the present invention, all of the prior art difficulties and drawbacks have been completely eliminated and a substantially improved, close and comfortable shaving system is attained which effectively cuts both short hair and long hair. Furthermore, by employing the present invention, a plurality of different shaving conditions are capable of being easily accommodated, thereby providing the user with a shaving system specifically designed for enabling a wide range of shaving conditions to be easily and effectively handled.

In accordance with the present invention, a separate and independent hair trimmer or trimming assembly is incorporated into the shaver system in direct association with the apertured foil or mesh screen cutting assembly in a manner which enables the hair trimming assemblies is to be employed simultaneously with the apertured foil cutting assemblies whenever desired by the user. In addition, in order to provide added flexibility and multi-purpose functionality, the hair trimming assembly is controllably movable into a variety of alternate positions. In order to assure ease of operation and control, a single, movable, multi-position, switch element is employed for altering the position of the trimmer assembly, placing the trimmer assembly in the precisely desired orientation or location. Furthermore, in the preferred embodiment, the trimmer assembly incorporates a pair of specially constructed cutting elements formed thereon for providing enhancing cutting and/or trimming capabilities in a wide variety of alternate operations.

In order to accommodate the typical variety of conditions experienced by most users of an electric dry shaving system, whether the system is being employed by men or women, it has been found that the hair trimming assembly is preferably able to be placed in at least three alternate positions. In the first desired position, the hair trimming assembly is maintained below the top surface of the mesh screen or apertured foil. In this position, the hair trimming assembly is maintained in a position which enables the apertured foil or mesh screen to provide the desired cutting action, with the hair trimming assembly being positioned in a manner which will not interfere or in any way impede the cutting operation of the apertured foil.

In the second desirable position, the hair trimming assembly is aligned with the upper, arcuately curved, top surface of one apertured foil or mesh screen for enabling the hair trimming assembly to be simultaneously employed with the apertured foil cutting assembly. In this way, both long hair and short hair are capable of being cut simultaneously as the shaver system is passed over any particular area to be shaved.

This construction is particularly useful by women when shaving their legs, which frequently require shaving of both long hair and short hair in the same area. In addition, men who have long and short hairs or whiskers experience a substantially enhanced shave with the trimmer in the second position. In this regard, the activation of the hair trimming assembly into its second position in combination with the apertured foil cutting assembly enables longer hair on beards to be cut partially by the trimmer, with the remaining shorter hair being cut completely by the apertured foil cutting assembly. In this way, substantially improved results are attained.

In a typical third position, the trimmer assembly is raised above the arcuately curved upper surface of the apertured foil cutting assembly, enabling the user to trim long hair fibers separately, without using the cutting action of the apertured foil. This position is typically used by men for cutting or trimming their sideburns, whenever needed.

In accordance with the present invention, each of these desired positions are quickly and easily achieved by the simple movement of a single button or switch. In accordance with this invention, the single rocker button or switch is employed which releases the trimmer assembly for movement from its stored position into the desired alternate positions. In the preferred embodiment, movement of the rocker switch in one direction causes the trimmer to move directly into its second position, aligned with the adjacent foil member. In addition, movement of the rocker switch in its alternate direction causes the trimmer assembly to move directly into its third position whether the trimmer is in its first or second position.

By employing the construction of the present invention, the movement of the single rocket switch controls the position of the trimmer assembly in a single, one step, easily achieved operation. In this way, the single rocker switch is capable of quickly and easily moving the trimmer assembly from its stored position directly into each of its alternate positions.

As mentioned above, an additional difficulty encountered with prior art trimmer assemblies is the rigidness inherent in virtually all constructions. As a result, once a trimmer assembly is placed in an operative position, the cutting action is activated. However, no vertical movement or vertical adjustability is capable of being provided by the prior art trimmer assemblies. Therefore, substantial discomfort during the shaving operation is frequently encountered as the trimmer passes over the contours found on the user's skin surface.

In order to overcome this prior art shortcoming, the trimmer assemblies of the present invention are preferably constructed in a manner which enables the trimmer assembly to be longitudinally movable in its normal plane of operation. In this way, a rigid operational position is eliminated and a substantial degree of flexibility and axial deflection is provided. By employing the present invention, the trimmer assembly is flexibly or longitudinally movable along with the contours of the skin surface over which the trimmer is moved. As a result, the varying contours of an individual skin surface are easily accommodated and a smooth, comfortable, close shave is realized.

The invention accordingly comprises the features of construction, combinations of elements and arrangement of parts which will be exemplified in the constructions hereinafter set forth, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

Figure 1:
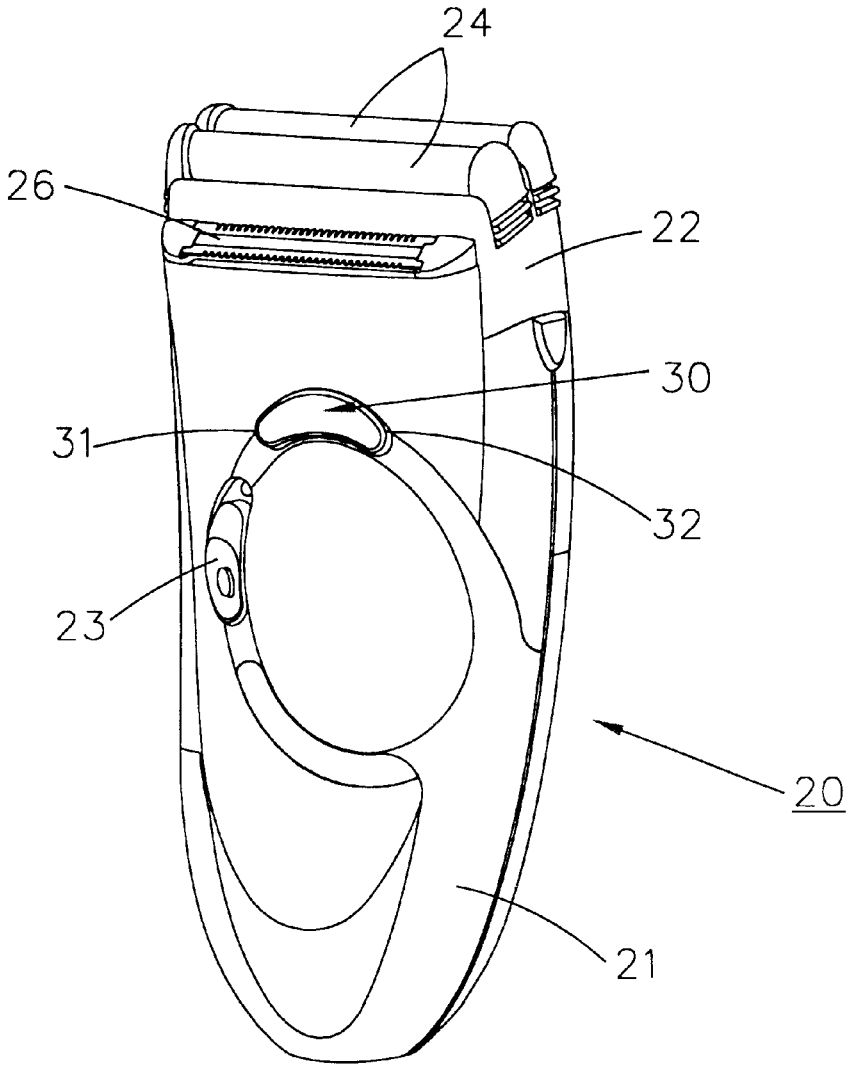
FIG. 1 is perspective view of one preferred embodiment of the shaving system of the present invention.
Figure 2:
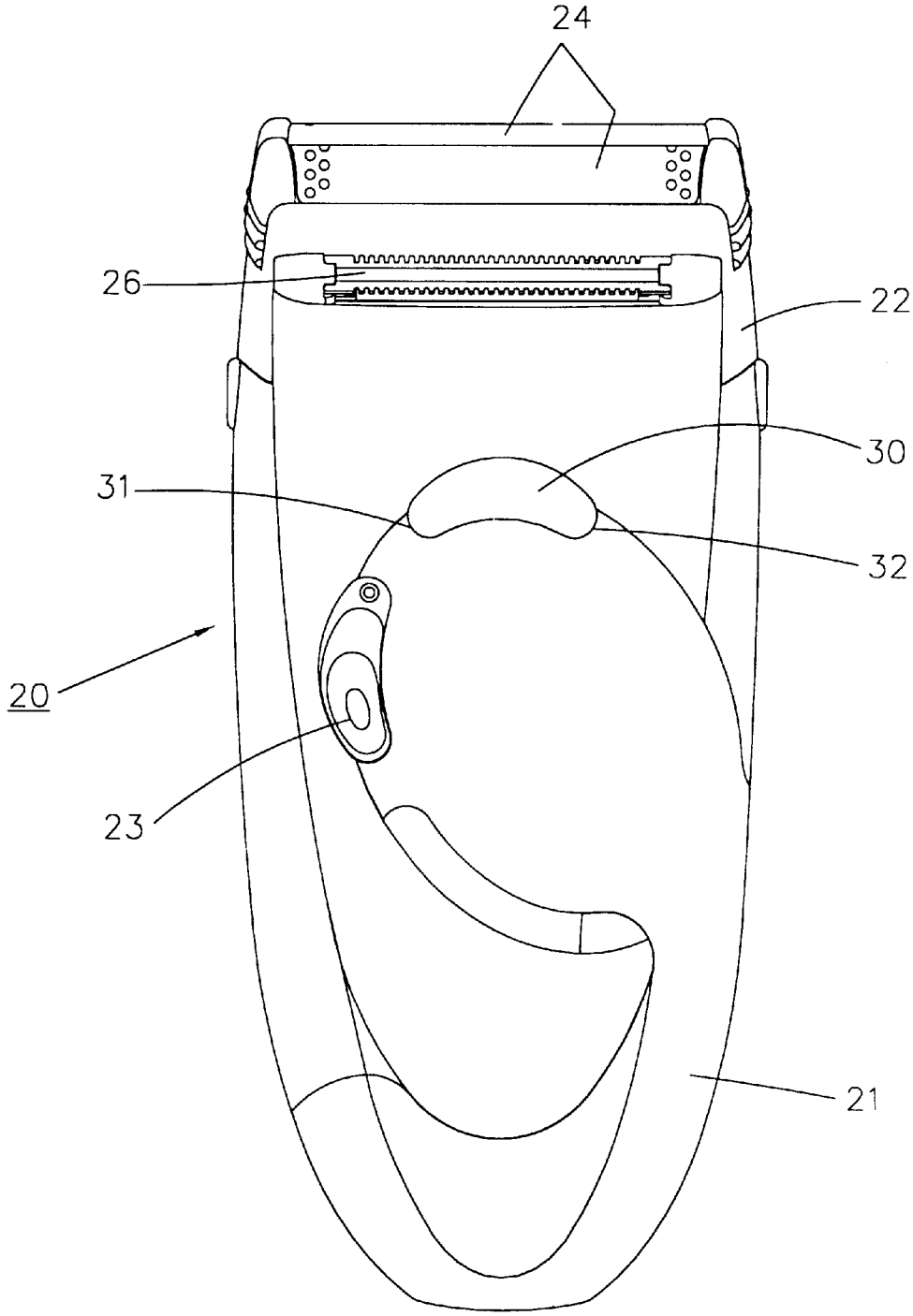
FIG. 2 is a front elevational view of this embodiment of the shaving system of the present invention.
Figure 4:
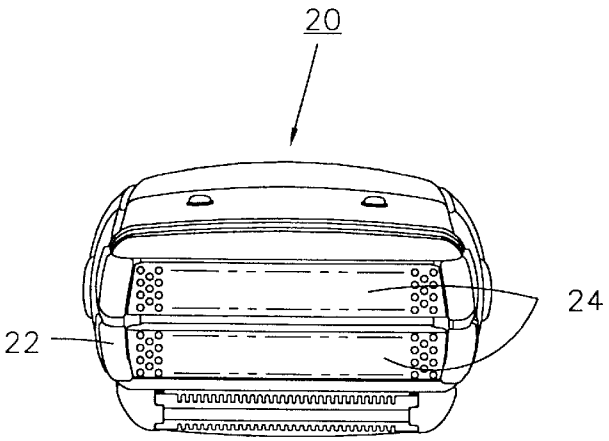
FIG. 4 is a top plan view of this embodiment of the shaving system of the present invention.
Figure 3:
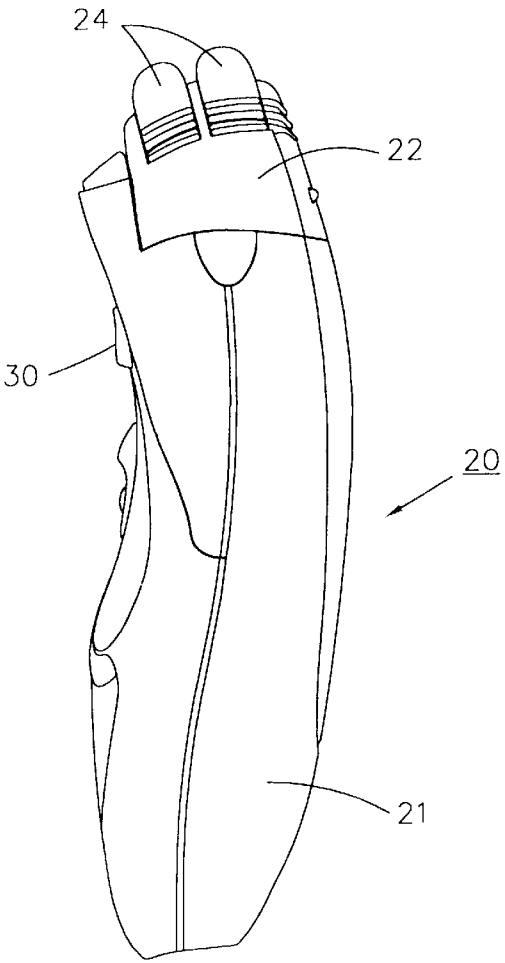
FIG. 3 is a side elevational view of this embodiment of the shaving system of the present invention.
Figure 5:
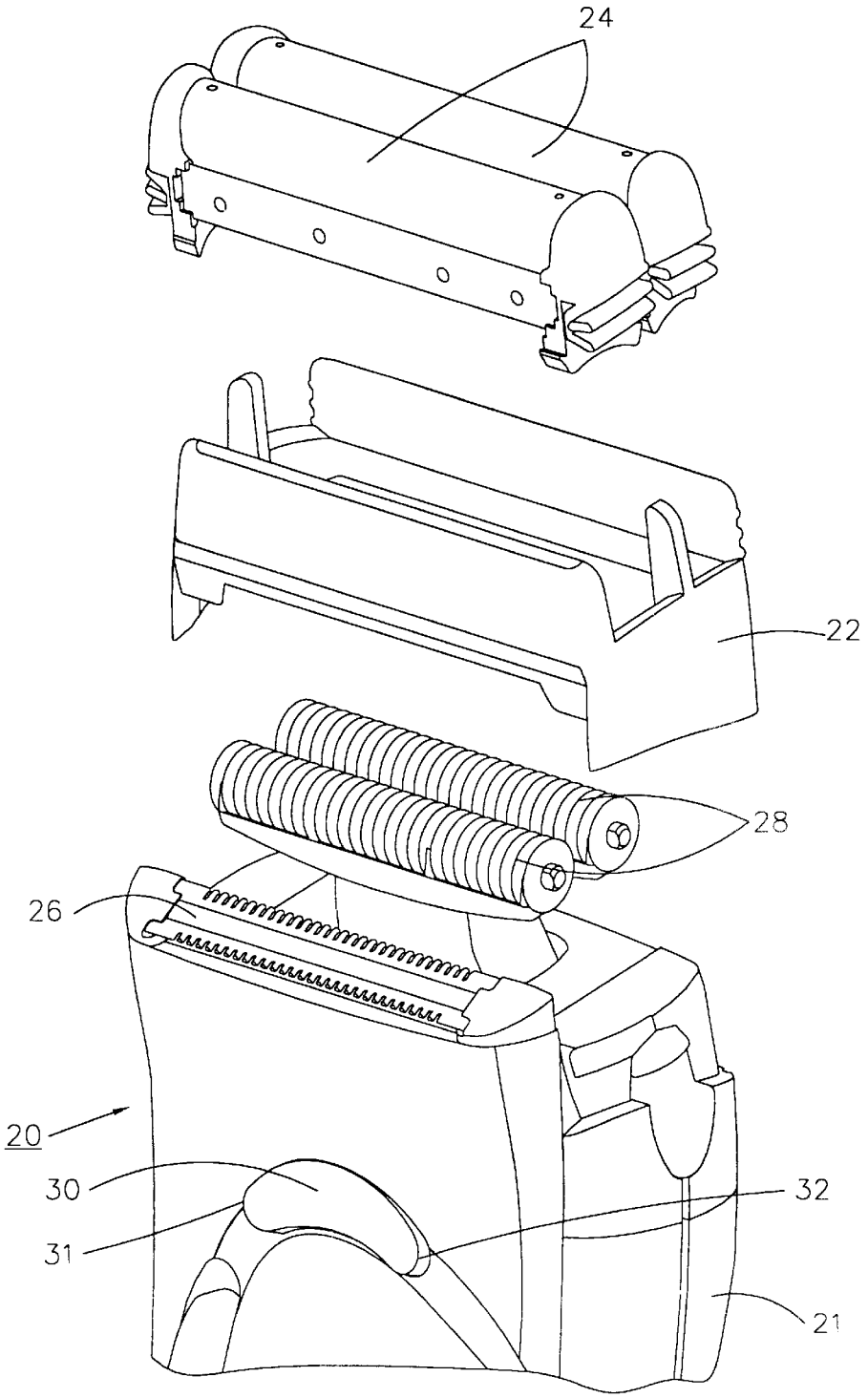
FIG. 5 is an exploded perspective view, partially broken away, of this embodiment of the shaving system of the present invention.
Figure 6:
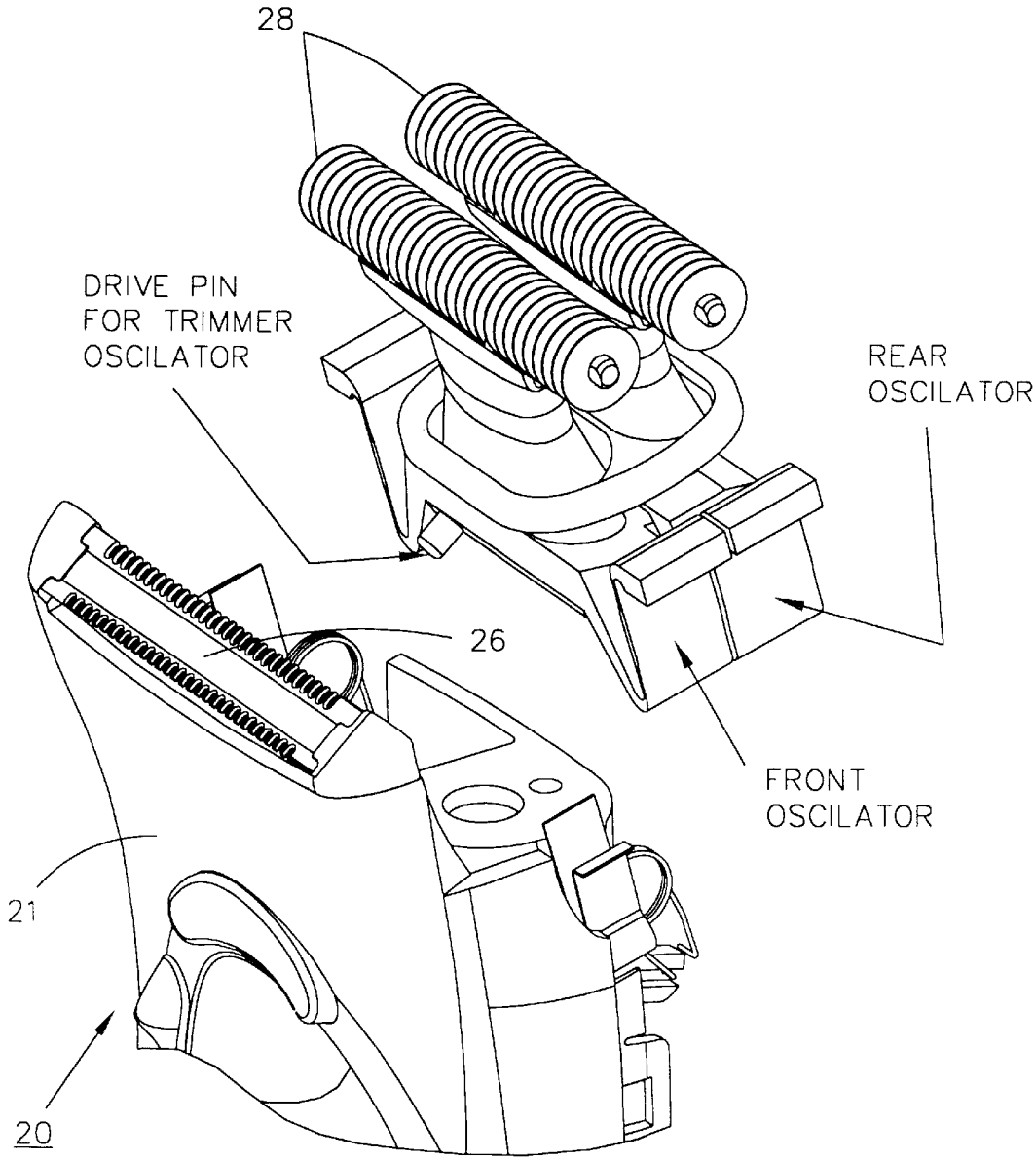
FIGS. 6 and 7 are exploded fragmentary views of this embodiment of the shaving system of the present invention.
Figure 7:
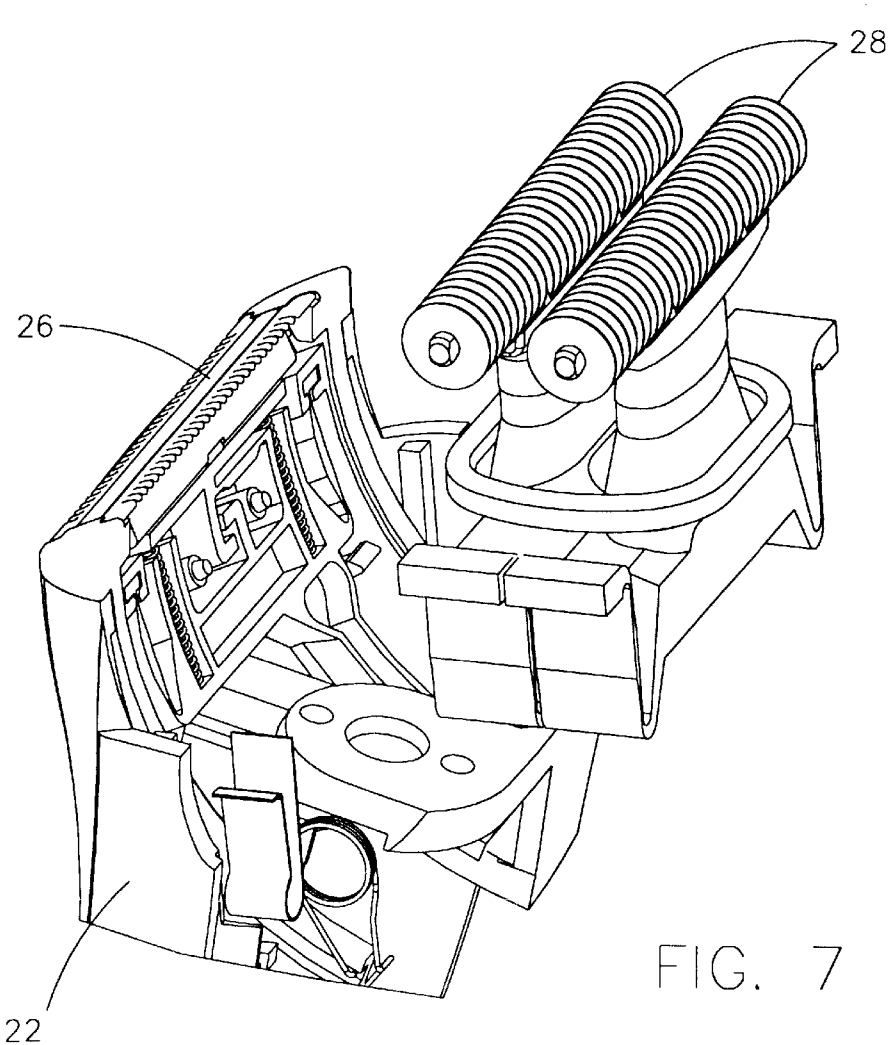
Figure 8:
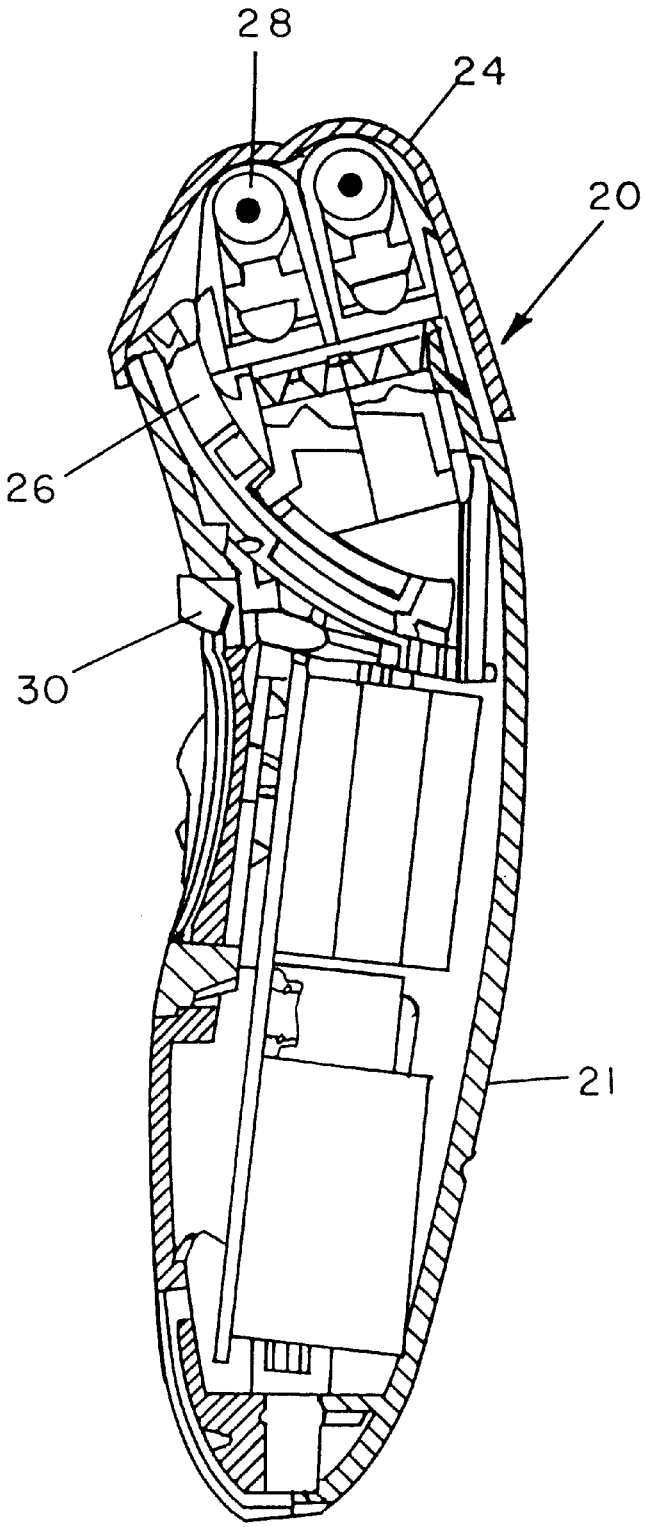
FIG. 8 is a cross-sectional side elevation view of this embodiment of the shaving system of the present invention.
Figure 9:
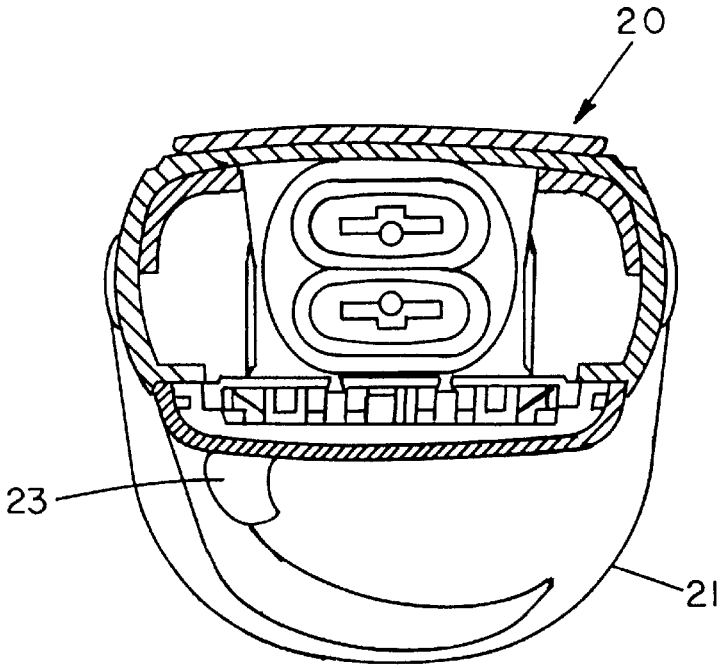
FIG. 9 is a cross-sectional plan view of this embodiment of the shaving system of the present invention taken along line 9—9 of FIG. 8.
Figure 10:
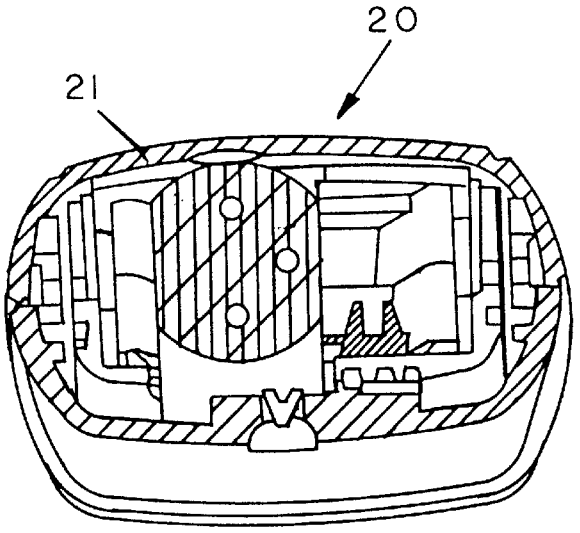
FIG. 10 is a cross-sectional plan view of this embodiment of the shaving system of the present invention taken along line 10—10 of FIG. 8.
Figure 56:
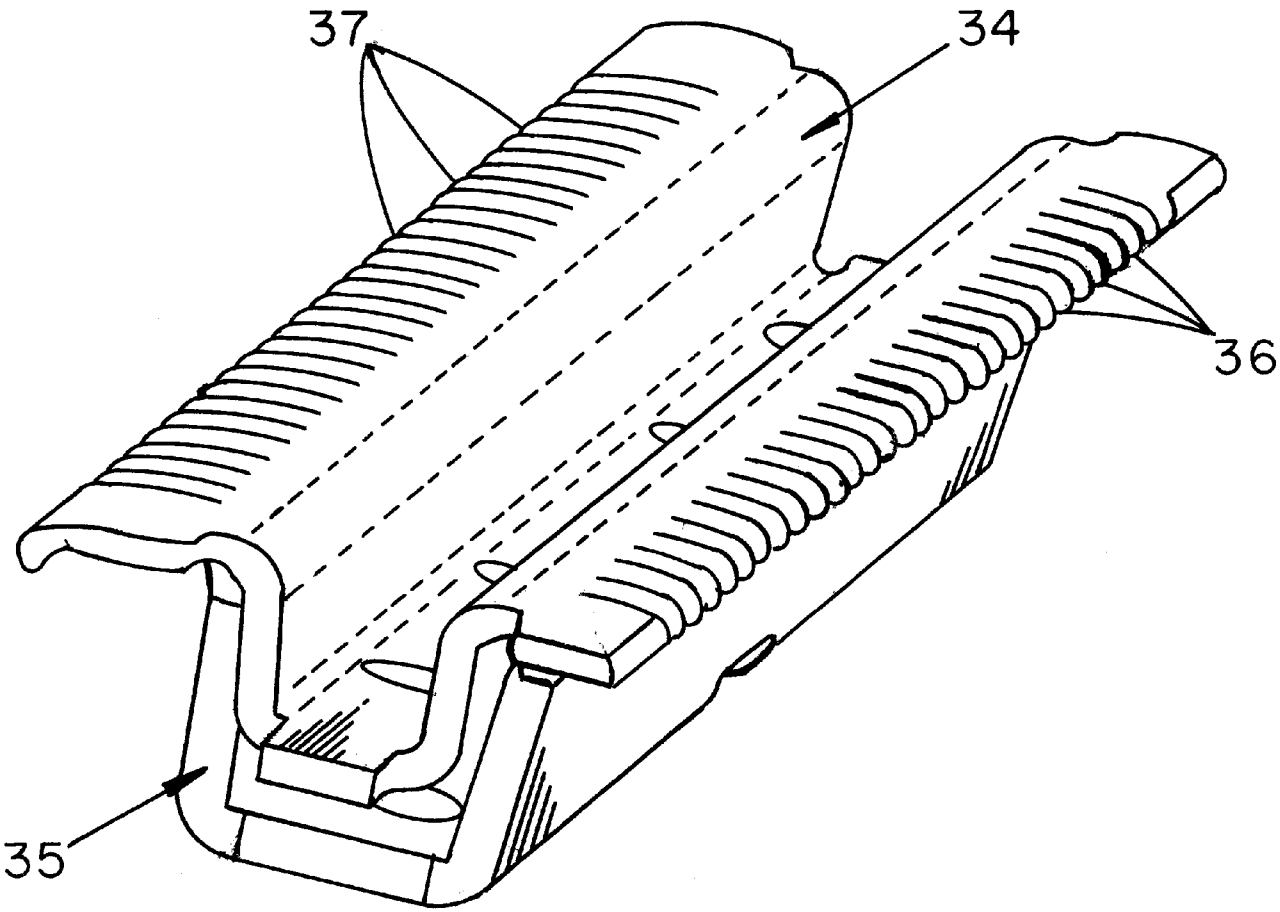
FIG. 56 is a perspective view depicting a preferred construction for the cutting blades employed in the trimmer assembly of the present invention.
Figure 58:
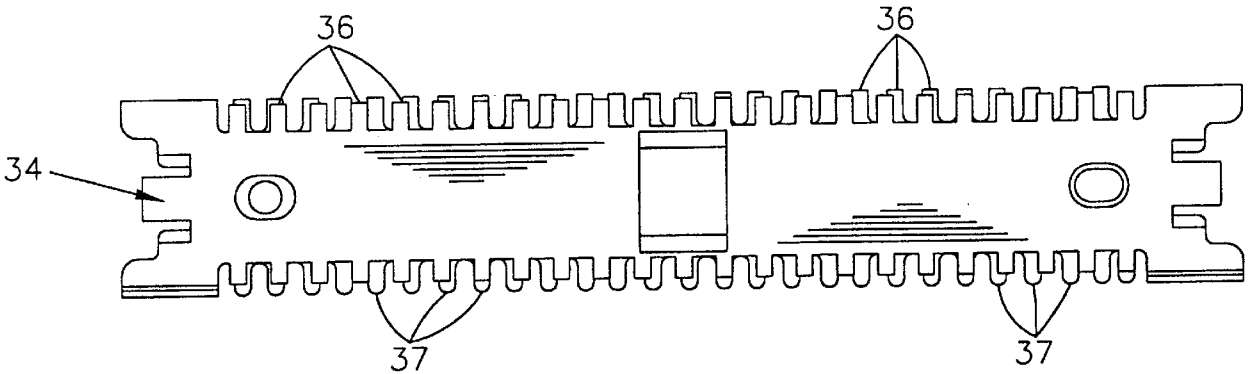
FIG. 58 is a top plan view of the cutting blades of FIG. 56.
Figure 57:
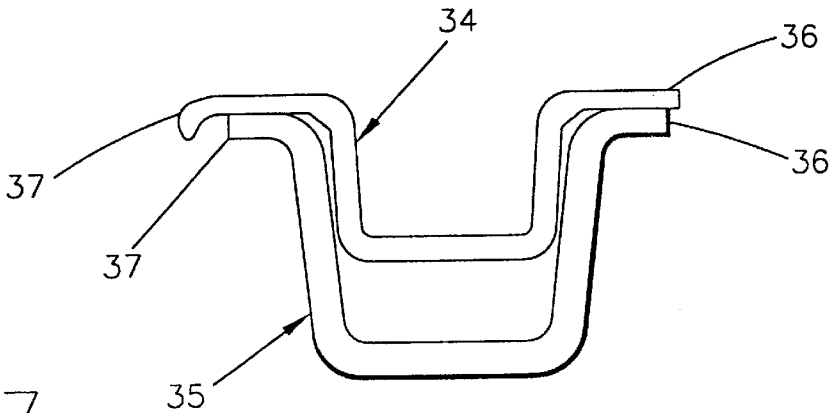
FIG. 57 is an end view of the cutting blades shown in FIG. 56.

By referring to FIGS. 1–56, along with the following detailed discussion, the construction and operation of two preferred alternate embodiments of the shaver system of the present invention can best be understood, thereby providing a complete detailed disclosure of the best mode for carrying out the present invention. However, as will be apparent to one of ordinary skill in this art, the present invention may be implemented in a wide variety of alternate constructions and configurations. Consequently, it is intended that the embodiments depicted in FIGS. 1–56 and detailed herein shall be considered as examples of the present invention and not as a limitation of the scope of protection afforded by this disclosure.

In FIGS. 1–25, electric dry shaver system 20 is depicted incorporating two cutting blade and mesh screen assemblies, while FIGS. 26–55 fully depict an alternate embodiment incorporating three cutting blade and mesh screen assemblies. In both embodiments, shaver system 20 comprises housing 21 to which guard/cover support base 22 is removably mounted. In addition, as fully detailed below, apertured foils or mesh screens 24 are mounted in cooperating relationship with cutting blade assemblies 28, and a movable trimmer assembly 26 is incorporated in shaver system 20 for providing the desired cutting of both long hair and short hair.

In the preferred construction of these embodiments, as best seen in FIGS. 1–7 and 26–33, two or three separate and independent apertured foils or mesh screens 24 are removably mounted to guard/cover support base 22 with trimmer assembly 26 also mounted to guard/cover support base 22 in juxtaposed, spaced, cooperating relationship with one apertured foil 24. In addition, in the conventional manner typically employed with electric dry shavers, housing 21 incorporates a motor which drives a rotatable shaft on which an eccentrically mounted drive pin is affixed. As best seen in FIGS. 5, 6, 27 and 28, the drive pin is controllably interconnected to separate and independent cutting blade assemblies 28, which are biasingly maintained in mating, contacting, hair cutting interengagement with apertured foils or mesh screens 24. Furthermore, both apertured foils 24 and cutting blade assemblies 28 are constructed for providing flexing movement during use, while being maintained in contact with each other.

By employing this construction, the activation of the motor by switch means 23 causes cutting blade assemblies 28 to move in the desired, side-to-side, reciprocating manner, while being maintained in contacting interengagement with the inside surface of one of the foil members 24. Preferably, guard/cover support base 22 is constructed for telescopic, overlying, locking inter-engagement with housing 21, in order to enable entry to the hair pocket for cleaning, as well as gaining access to cutting blades 28 and foil members 24, whenever required for cleaning, removal and/or replacement.

Figure 55:
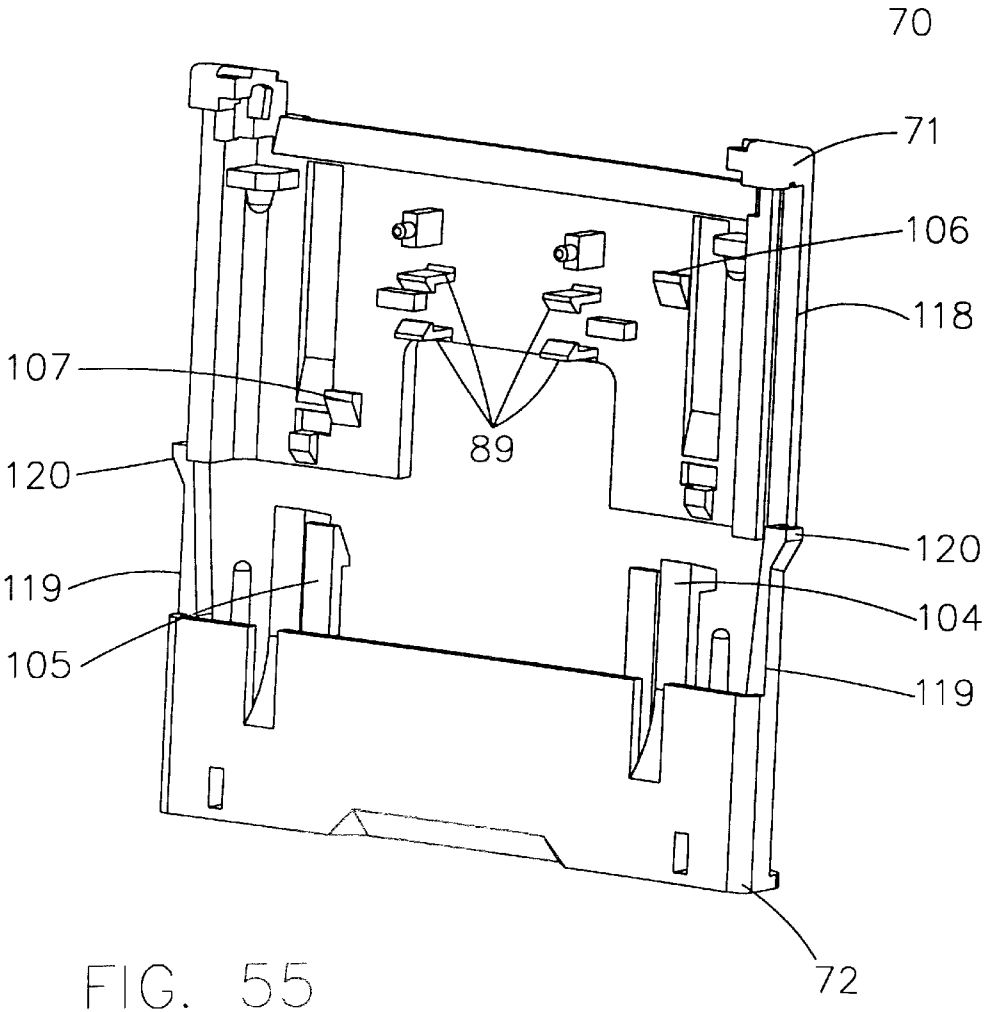
FIG. 55 is an exploded rear perspective view of the trimmer assembly of FIG. 51 shown with some internal components removed.

In both of the embodiments detailed herein and depicted in FIGS. 1–55, two alternate constructions are fully disclosed for providing an electric dry shaver incorporating a trimmer capable of overcoming all of the prior art difficulties and satisfying the long, unresolved needs of this industry. In this regard, as shown in FIGS. 11–19 and 34–45, trimmer assembly 26 of the present invention is constructed having three alternate positions. In one of these alternate positions, trimmer assembly 26 is in the stored position, wherein the cutting teeth or blades forming the trimmer are positioned below the surface of apertured foils 24 in order to enable shaver system 20 to be employed without any trimmer function. Typically, in this position, no power is delivered to the trimming blades and the trimming blades are inactivated.

In the second position, trimmer assembly 26 is moved from the stored position into the intercept position, wherein the cutting edges of trimmer assembly 26 are aligned with the adjacent apertured foil 24. In the final position, trimmer assembly 26 is raised above apertured foils 24, thereby enabling longer hairs, such as sideburns, to be cut independently of the apertured foils 24.

As is more fully detailed below, both preferred embodiments of the present invention employ trigger activation switch 30 in order to move trimmer assembly 26 from its store positioned into either of its two alternate positions. In the preferred construction, trigger activation switch 30 comprises a rocker switch or a toggle switch having a single rest or inactive position, and two separate and independent alternate modes, directions, or positions into which switch 30 can be moved. Throughout the drawings, trimmer activation switch 30 is depicted as a rocker switch, having a first end 31, the movement of which activates trimmer assembly 26 to move from its first position to its second position, and a second end 32, the movement of which activates trimmer assembly 26 to move into the third alternate position.

By employing this construction, when end 31 of switch 30 is moved, trimmer assembly 26 automatically moves from its stored position into its second or intercept position. In addition, when end 32 of switch 30 is moved, trimmer assembly 26 moves either from the stored positioned or the intercept position directly into the third, fully raised position. In this way, activation of trimmer assembly 26 into any precisely desired alternate position is quickly and easily attained.

As is more fully detailed below, both preferred embodiments of the present invention are capable of achieving the desired movement and positioning of trimmer assembly 26 by employing activation switch 30. In addition, whenever trimmer assembly 26 is to be returned to its original, stored position, manual movement of trimmer assembly 26 is employed for guiding trimmer assembly 26 from one of its raised positions to its stored position. Whenever such manual activation is employed, the locking means incorporated into trimmer assembly 26 of the present invention automatically cam out of position and enable the downward movement of trimmer assembly 26 to be achieved.

In addition, as fully detailed below, trimmer assembly 26 is constructed for vertical, floating movement when in its second, intercept position. In this way, movement of trimmer assembly 26 is attained along with the vertical movement of apertured foils 24 as both components are moved over an area to be shaved. As a result, substantially improved and enhanced long and short hair cutting is attained.

By referring to FIGS. 1–25, along with the following detailed discussion, the preferred construction and operation of trimmer assembly 26 in one preferred embodiment of shaving system 20 of the present invention can best be understood. In this embodiment, trimmer assembly 26 comprises an arcuately curved longitudinally extending shape which is retained within an arcuately curved receiving zone or pocket 33 formed in housing 21 of shaver system 20. By providing this arcuately curved configuration for trimmer assembly 26 and receiving zone 33, precisely controlled movement of trimmer assembly 26 relative to shaver system 20 is realized and optimum positioning of trimmer assembly 26 relative to apertured foil 24 is attained.

Figure 12:
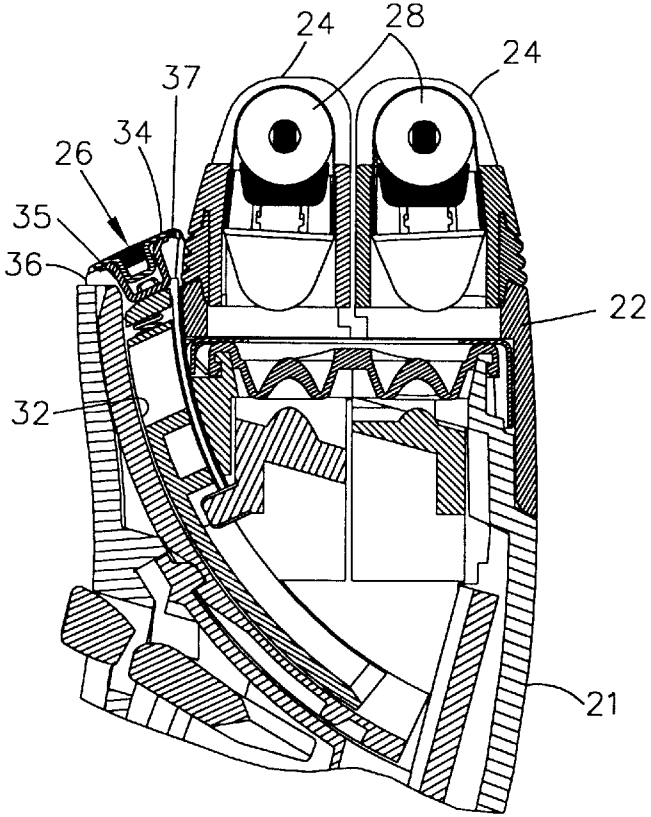
FIGS. 11–16 are fragmentary front and cross-sectional side elevational views of this embodiment of the shaving system of the present invention depicting the trimmer in its three alternate positions.
Figure 11:
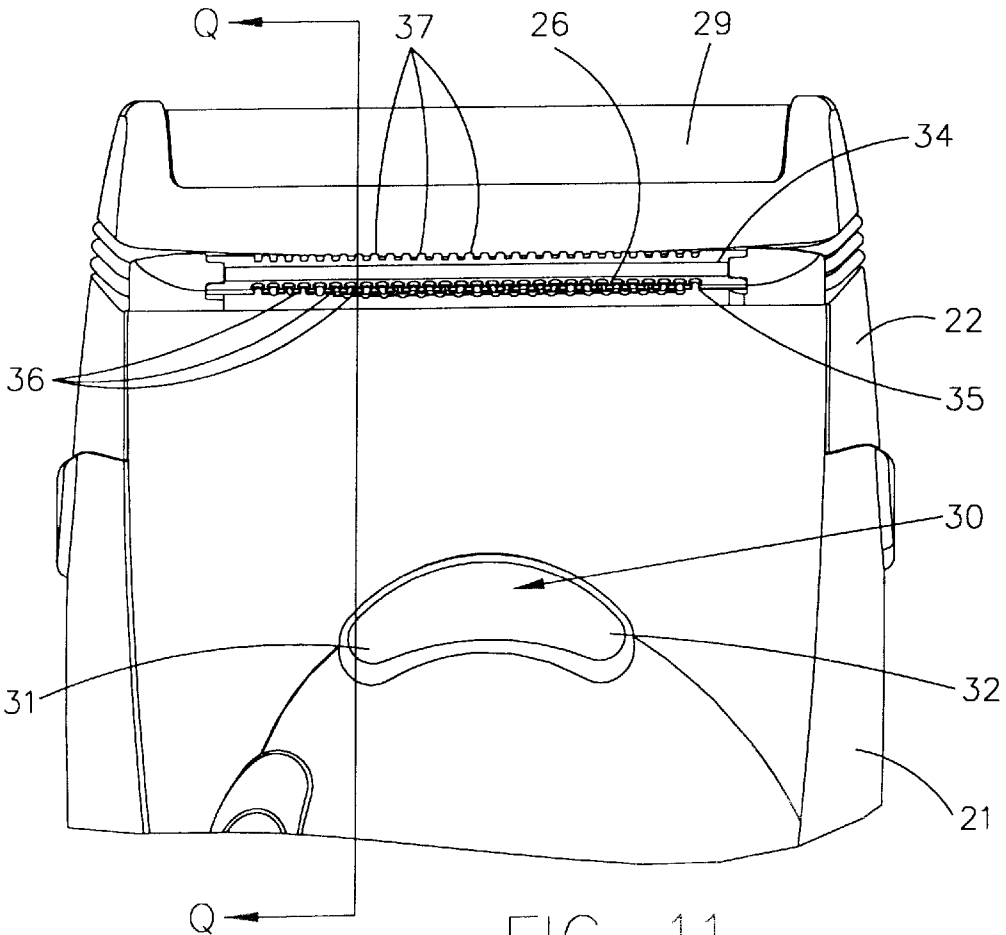
Figure 14:
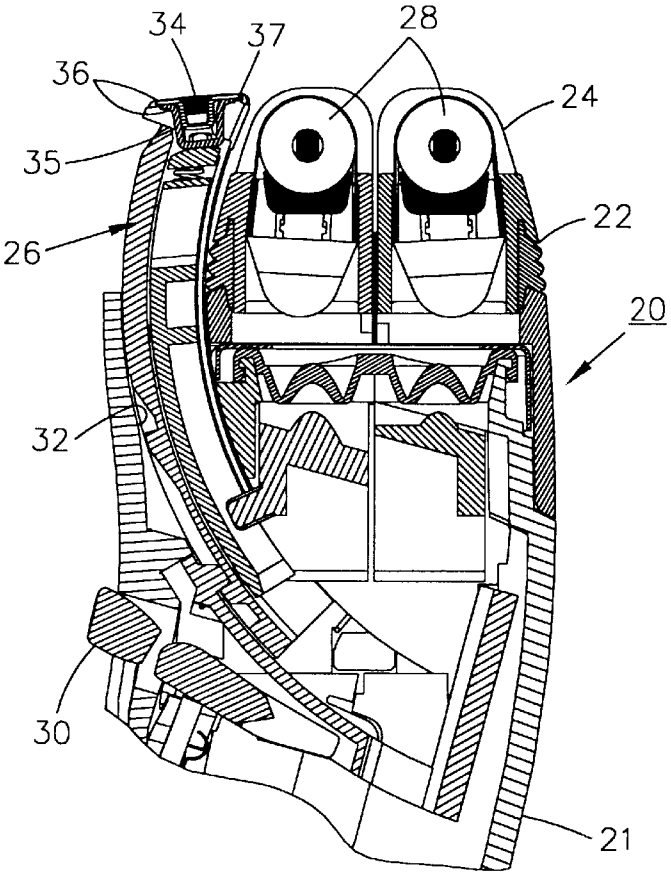
Figure 13:
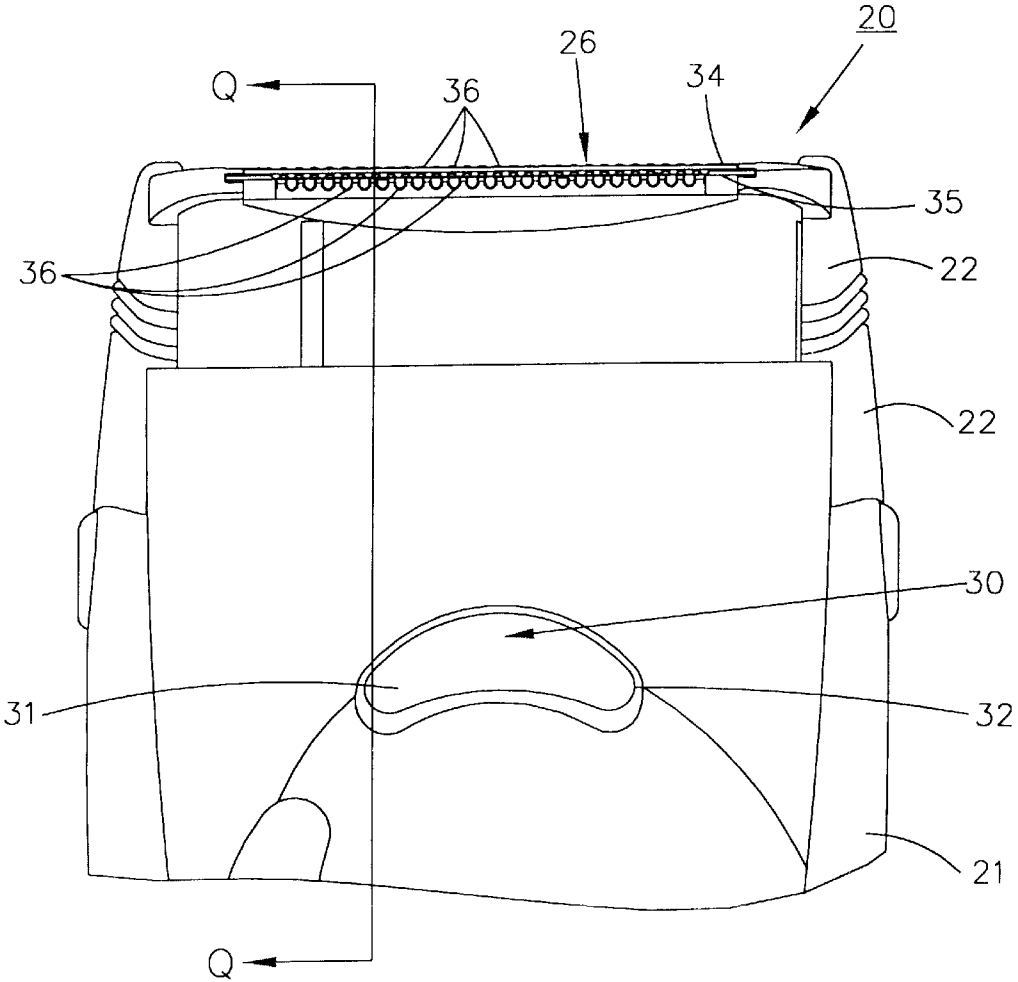
Figure 16:
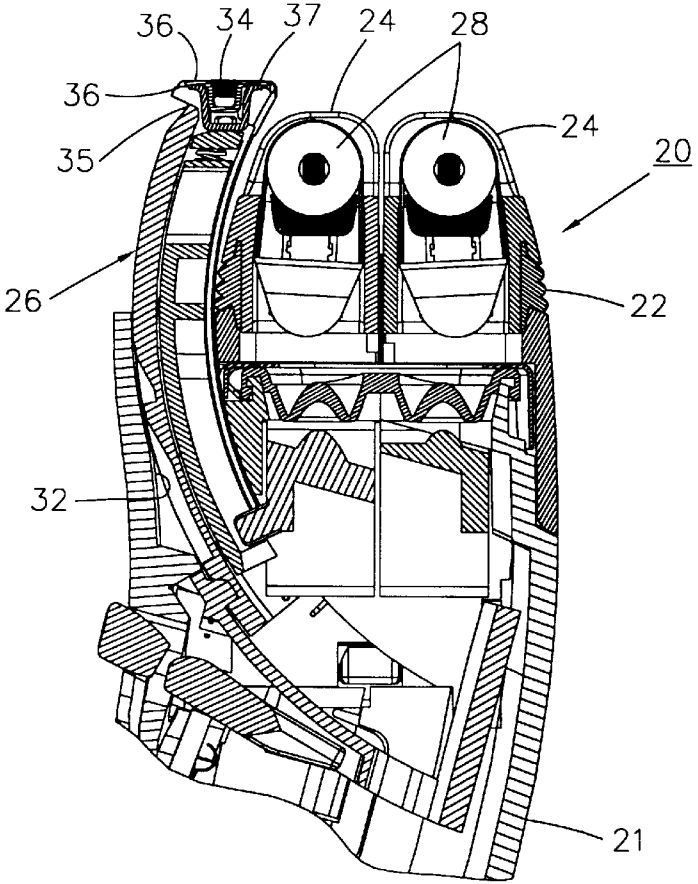
Figure 15:
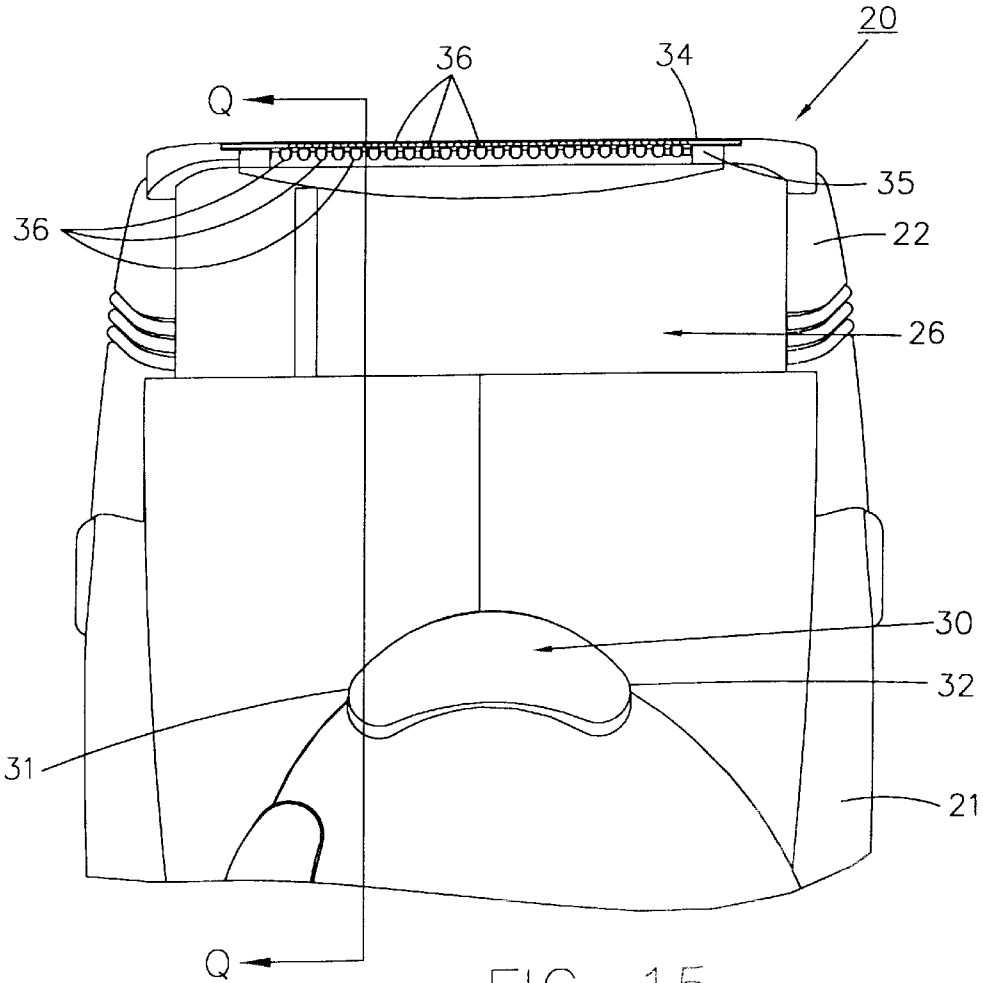
Figure 17:
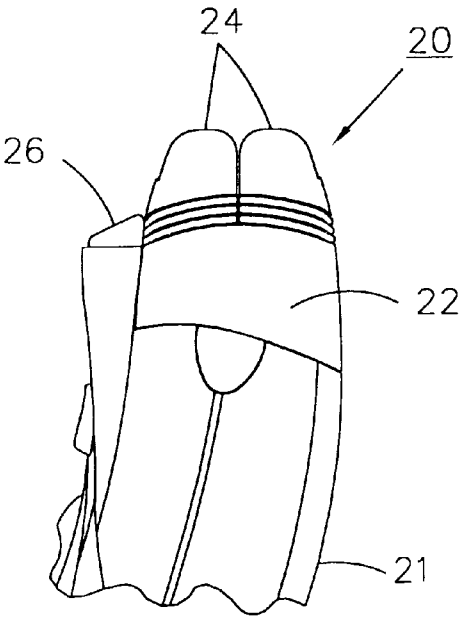
Figure 20:
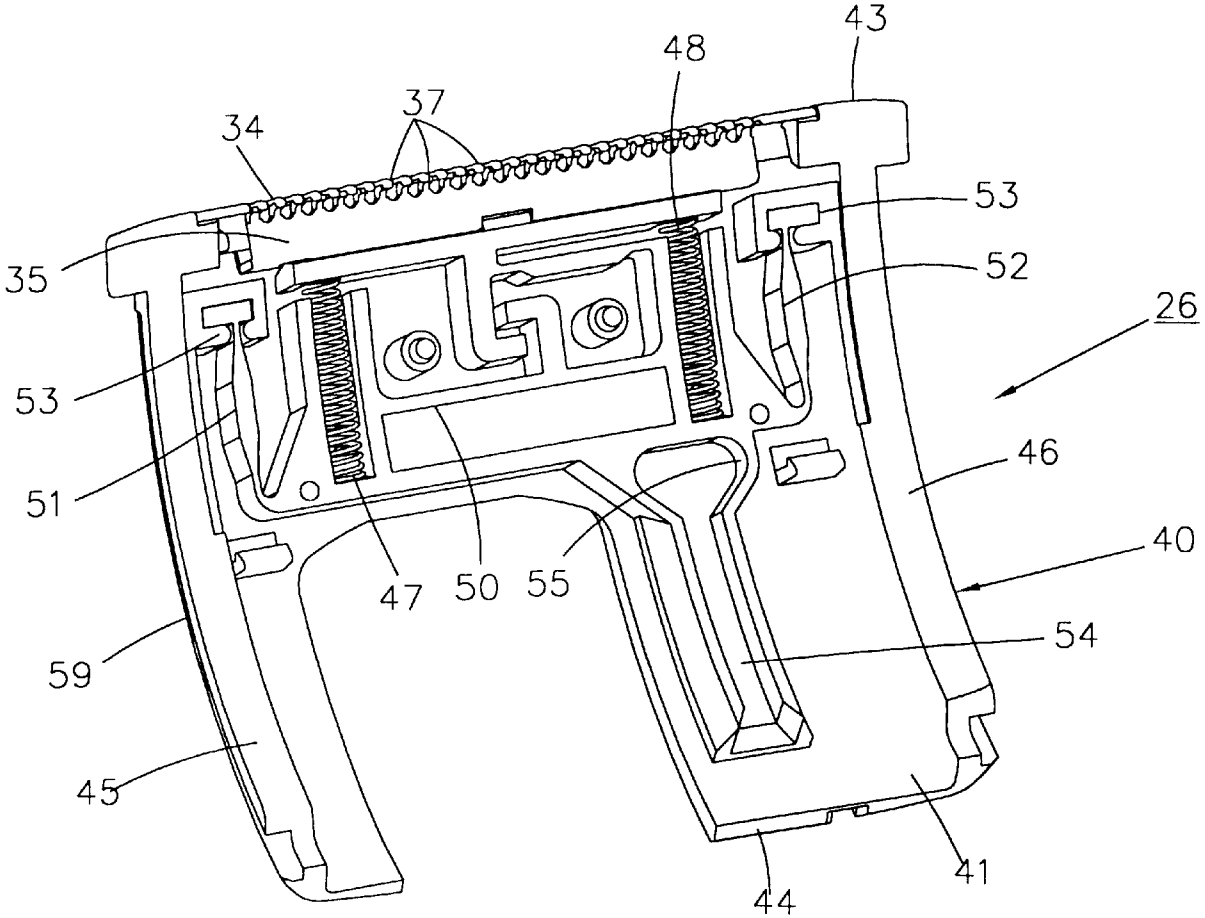
FIG. 20 is a rear perspective view of the trimmer assembly of the present invention for mounting in the shaver system of FIG. 1.
Figure 21:
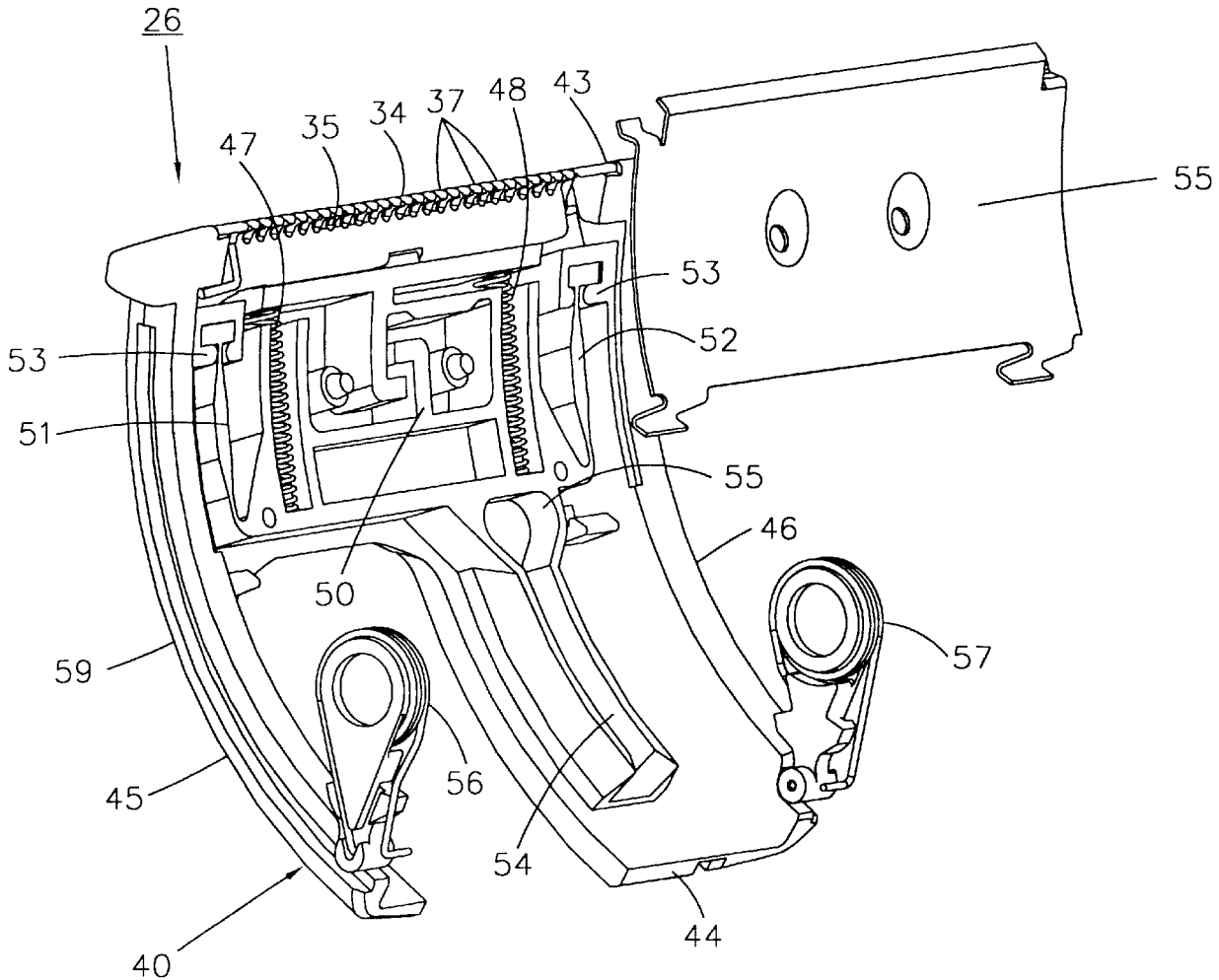
FIG. 21 is a rear perspective view of the trimmer assembly of FIG. 20 showing a cover and torsion springs associated therewith.
Figure 22:
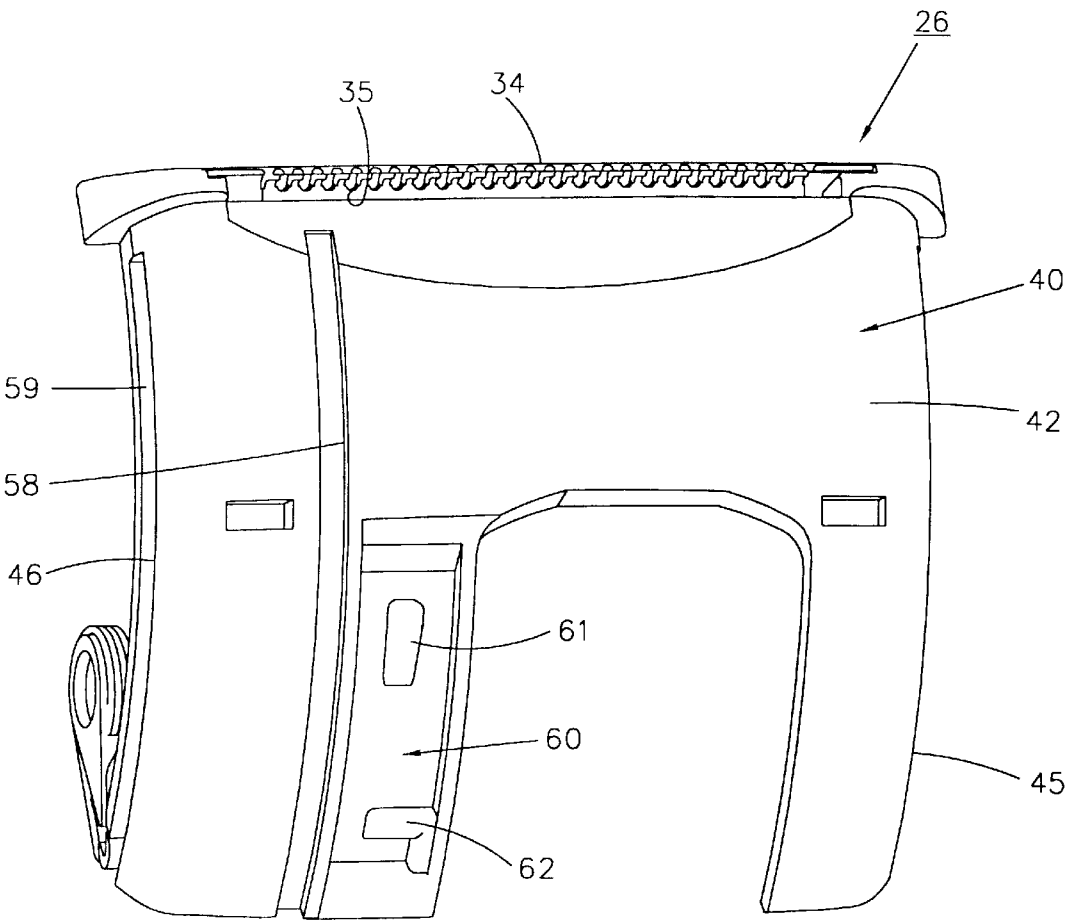
FIG. 22 is a front perspective view of the trimmer assembly of FIG. 20.

In FIGS. 11, 12, and 17, the first, stored position of trimmer assembly 26 in housing 21 of shaver 20 is fully depicted. In this position, trimmer assembly 26 is maintained in a position below apertured foils/mesh screens 24 and cutting blades 28. In this position, trimmer assembly 26 is not operational, thereby allowing mesh screens 24 and cutting blades 28 to be employed for providing the desired shaving.

In its preferred construction, trimmer assembly 26 comprises fixed cutting blade member 34 and movable cutting blade member 35, which is mounted in cooperating, sliding engagement with blade member 34. In the preferred construction, cutting blade members 34 and 35 are mounted along the top edge of trimmer assembly 26, with blade member 35 interconnected with a movement control arm which is drivingly engaged with the motor for attaining the desired side to side, reciprocating movement.

In addition, cutting blade members 34 and 35 each incorporate a forwardly extending row of cutting teeth 36 and a rearwardly extending row of cutting teeth 37. By mounting blade members 34 and 35 in sliding cooperating engagement with each other, with cutting teeth 36 and 37 of each blade member being maintained in cooperating, sliding engagement with each other, the movement of blade member 35 relative to blade member 34 enables the cutting teeth thereof to provide the desired cutting action. In this way, the desired trimming of the longer hair fibers is achieved.

As discussed above, when trimmer assembly 26 is in its first, stowed position, movement of cutting blade member 35 is not required, since trimmer assembly 26 is positioned away from the skin surface of the user. As a result, as further detailed below, in the preferred construction, cutting blade member 35 remains idle when in this position.

Whenever the user wishes to activate trimmer assembly 26 into its second, intercept position, end 31 of trigger activation switch 30 is moved, causing trimmer assembly 26 to automatically move from the stored position into the desired second or intercept position. This second position is clearly depicted in FIGS. 13, 14, and 18.

In this position, cutting blade members 34 and 35 of trimmer assembly 26 are aligned with the adjacent apertured foil 24 for providing cooperating, cutting action therewith. In this position, cutting blade members 34 and 35 of trimmer assembly 26 are capable of cooperating with apertured foils 24 and cutting blade assemblies 28 to assist in cutting longer hair fibers simultaneously with the cutting of the shorter hair fibers by apertured foils 24 and cutting blade assemblies 28.

By providing simultaneous cutting of long hair fibers and short hair fibers, as well as the initial trimming of hair fibers by trimmer assembly 26 followed by closer shaving of the hair fiber by apertured foils 24 and cutting blade assemblies 28, a user is able to effectively shave any desired length of hair fiber. Such mixed hair fiber length are typically encountered in a beard after the hair fibers have been allowed to grow for one or more days.

Whenever a user wishes to separately trim any desired area, such as side burns, mustaches, etc., independently of the apertured foils 24, activation switch 30 is moved, causing trimmer assembly 26 to automatically move into the third alternate position. In this position, depicted in FIGS. 15, 16 and 19, trimmer assembly 26 is raised above apertured foils 24. In the preferred embodiment of the present invention, trimmer assembly 26 automatically moves into the third position from either the stored position or the intercept position whenever end 32 of activation switch 30 is moved.

When trimmer assembly 26 is placed in its third alternate position, cutting blade members 34 and 35 of trimmer assembly 26 are positioned in a readily accessible location for enabling cutting blade members 34 and 35 to be employed in any desired manner for cutting or trimming longer hair fibers, such as found on mustaches, beard edges, and sideburns, independently of apertured foils 24. In this way, a convenient, more precise trimming function is achieved.

As is evident from the foregoing detailed disclosure and FIGS. 11–19, controlled movement of trimmer assembly 26 is attained by providing an arcuately curved construction, which is retained within arcuately curved receiving zone or pocket 33 of housing 21. In particular, in the second or intercept position, this construction of trimmer assembly 26 enables cutting teeth 36 and 37 of blade members 34 and 35 of trimmer assembly 26 to be positioned in close proximity to apertured foils 24. As a result, a synergistic interaction of these elements is established and optimum performance is realized.

Figure 19:
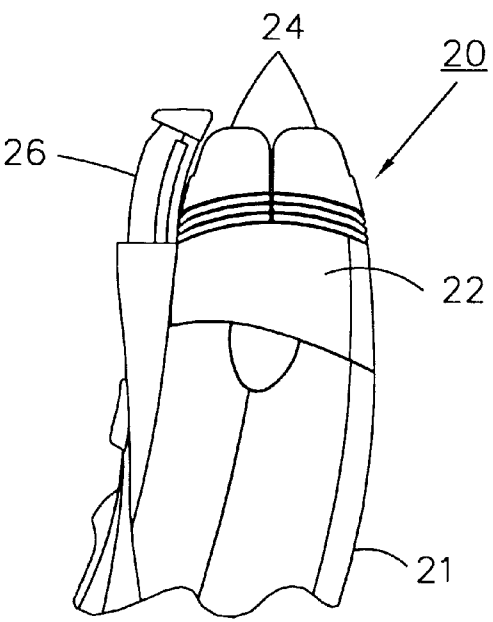
FIGS. 17–19 are side elevational views of this embodiment of the shaving system of the present invention depicting the three alternate positions of the trimmer assembly.
Figure 18:
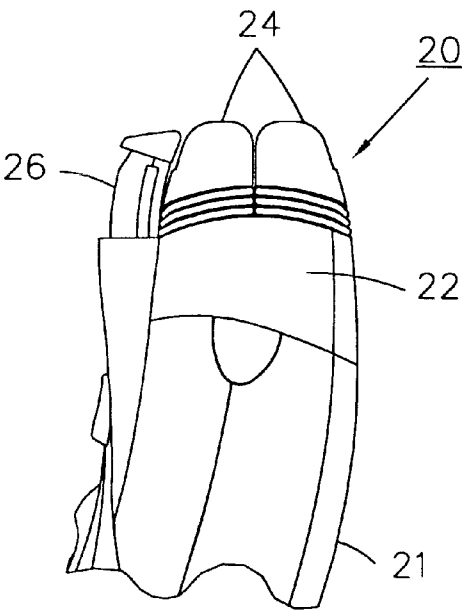

In addition to providing an optimum position for cooperating with apertured foils 24, the arcuately curved construction of trimmer assembly 26 also places the cutting blade members 34 and 35 of trimmer assembly 26 in a desirable cutting orientation when positioned in the uppermost or trim position. Due to the arcuate movement of trimmer assembly 26, blade members 34 and 35 are angularly tilted relative to apertured foils 24, as shown in FIG. 19, thereby providing a desirable and advantageous cutting orientation and cutting angle. As a result, precise trimming of mustaches, beards, and sideburns is easily achieved due to the unique arcuate construction of trimmer assembly 26.

By referring to FIGS. 20–25 along with the following detailed disclosure, the preferred construction of this embodiment of trimmer assembly 26 can best be understood. In the preferred construction of this embodiment, trimmer assembly 26 incorporates housing 40 which comprises an overall, arcuately curved shape, as depicted throughout the Figures, and discussed above. In addition, housing 40 comprises inside surface 41, outside surface 42, top or upper edge 43, bottom edge 44, and side edges 45 and 46.

As discussed above, trimmer assembly 26 incorporates fixed, stationery, cutting blade member 34 which is mounted along the top edge 43 of housing 40, extending substantially the entire length thereof. Furthermore, fixed, stationary cutting blade member 34 incorporates a forwardly extending row of cutting teeth 36 and a rearwardly extending row of cutting teeth 37, both of which extend substantially the entire length of cutting blade member 34.

In order to attain the desired hair cutting action, trimmer assembly 26 also incorporates movable cutting blade member 35 which is mounted in cooperating interengagement with fixed cutting blade member 34. Movable cutting blade member 35 also incorporates a forwardly extending row of cutting teeth 36 and a rearwardly extending row of cutting teeth 37, both of which are aligned with and cooperatingly associated with the respective cutting teeth of blade member 34. Furthermore, in order to assure that movable cutting blade member 35 is maintained in contact with fixed cutting blade member 34, spring means 47 and 48 are employed and positioned for continuously forcing or biasing movable cutting blade member 35 upwardly into contacting engagement with fixed cutting blade member 34.

In order to provide the desired controlled, side to side, reciprocating movement of cutting blade member 35 relative to fixed, stationary cutting blade member 34, trimmer assembly 26 incorporates slider plate 50 mounted to inside surface 41 of housing 40. In the preferred embodiment, slider plate 50 incorporates holding zones for securely retaining spring means 47 and 48 in a manner which enables the biasing engagement of blade members 35 to be attained. In addition, slider plate 50 is supportingly mounted to inside surface 41 of housing 40 by support arms 51 and 52. As depicted, each support arms 51 and 52 is secured at its terminating end to a holding clip 53 which is formed on inside surface 41 of housing 40. By employing this construction, slider plate 50 is free to move sideways between side edges 45 and 46 of housing 40, suspended by arms 51 and 52 while also being movable in the precisely desired controlled manner.

In order to impart the desired movement to slider plate 50 for controllably driving movable blade member 35, slider plate 50 incorporates an elongated, keyhole-shaped slot 54 which is constructed for being positioned in controlled engagement with a drive pin associated with the drive system which controllably moves cutting blade assemblies 28. The construction of keyhole shaped slot 54 assure that slider plate 50 is continuously moved in the desired side to side manner whenever trimmer assembly 26 is in its second or third position. However, by incorporating enlarged open zone 55 as part of keyhole shaped slot 54, the movement of the drive pin associated with the cutting blade assemblies 28 merely moves in its normal manner, without affecting the movement of slider plate 50 when trimmer assembly 50 is in its stored position. In this way, whenever trimmer assembly 26 is in its first, stored position, slider plate 50 does not move and cutting blades 34 and 35 remain idle.

In order to complete the overall construction of trimmer assembly 26, a substantially flat cover plate or shield 55 is employed for overlying slider plate 50 and all of its associated components, thereby protecting these components from dust, dirt, and debris. In addition, movement controlling torsion spring members 56 and 57 are mounted at the juncture between side edges 45 and 46 with bottom edge 44. Spring members 56 and 57 control the upward movement of trimmer assembly 26 whenever switch 30 is activated.

In addition, as detailed above, whenever trimmer assembly 26 is to be returned to its original, stored position, manual movement of trimmer assembly 26 is employed. In this way, the spring forces being exerted by torsion spring means 56 and 57 are overcome, and trimmer assembly 26 is returned to its first, stored position.

In order to provide the desired controlled movement of trimmer assembly 26, in accordance with the teaching of the present invention, wherein trimmer assembly 26 is capable of being moved directly from its first, stored position into either its second, intercept position or its third, fully raised position, a unique movement control system is employed. In this regard, outside surface 42 of housing 40 of trimmer assembly 26 incorporates an elongated slot 58 extending substantially the entire length of housing 40. Although not required, it has been found that slot 58 is desirable, providing a controlled track for guiding and controlling the movement of trimmer assembly 28. In addition, if desired, slots 59 may be formed in side ages 45 and 46 to provide a similar movement controlling function.

The principal control over the movement of housing 40 of trimmer assembly 26 is provided by forming a recess zone 60 in outside surface 42 of housing 40 and incorporating ledge 61 and elongated ridge 62 in recess zone 60. As clearly shown in FIG. 22, in the preferred construction, ridge 62 is formed near the base of recess zone 60, extending a major portion of the width of recess zone 60 without extending the entire width thereof. In addition, ledge 61 is formed near the upper end of recess zone 60, positioned in juxtaposed, spaced, vertically aligned relationship with ridge 62.

In addition, in order to provide the desired control and linkage between recessed zone 60 and activation switch 30, lever assembly 64 is employed. By referring to FIGS. 23, 24 and 25, along with the following detail disclosure, the construction and operation of lever assembly 64 can best be understood.

In the preferred construction, three-position activation switch 30 comprises an elongated finger member 65 which extends rearwardly from switch 30, with its terminating end securely mounted between cooperating walls 66 of lever assembly 64. In addition, switch 30 is cooperatively associated with spring member 67 which is constructed for continuously biasing switch 30 to return to its central position, whenever end 31 or end 32 is pressed. As a result, switch 30 is self-centering.

In its preferred construction, lever assembly 64 is formed from thin, flexible, plastic material, incorporating, in addition to upstanding walls 66, an enlarged plate member 68 on which locking pin 69 is mounted. Due to the flexible nature of lever assembly 64, movement of activation switch 30, in either of its two alternate directions, causes lever assembly 64 to move simultaneously therewith.

Figure 23:
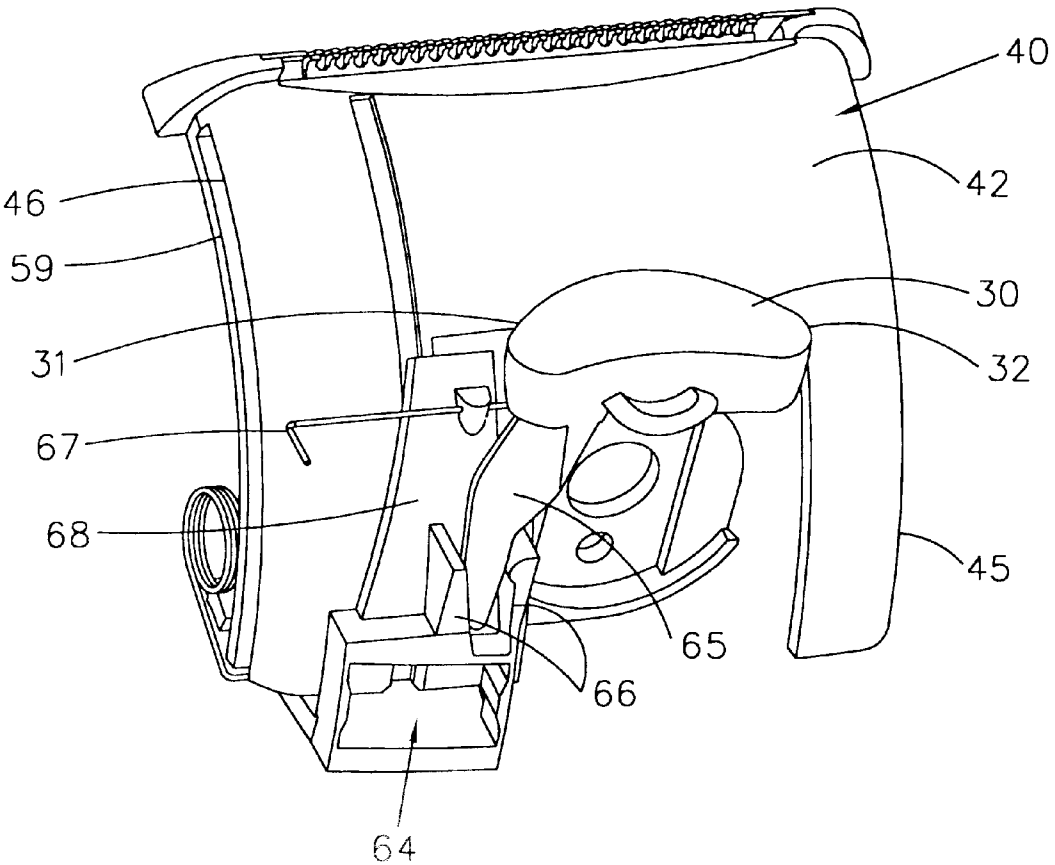
FIG. 23 is a front bottom perspective view of the trimmer assembly of FIG. 20 showing the activation switch and lever assembly associated therewith.
Figure 24:
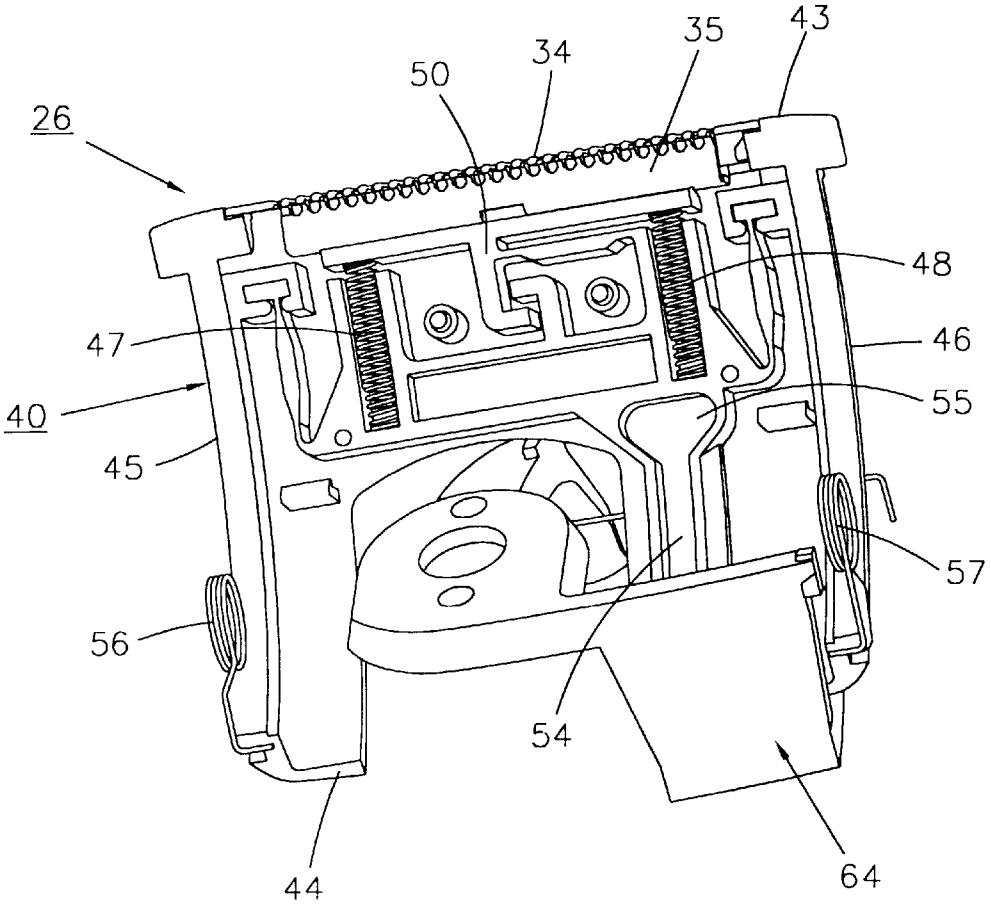
FIG. 24 is a rear bottom perspective view of the trimmer assembly of FIG. 20 showing the lever assembly associated therewith.
Figure 25A:
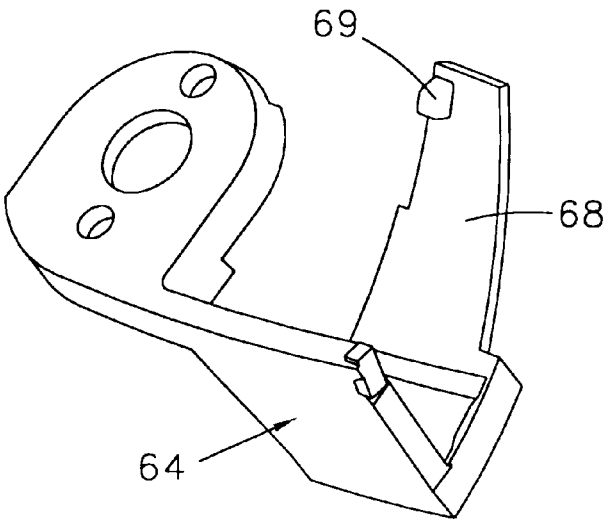
FIG. 25A is a rear perspective view of the lever assembly.
Figure 25:
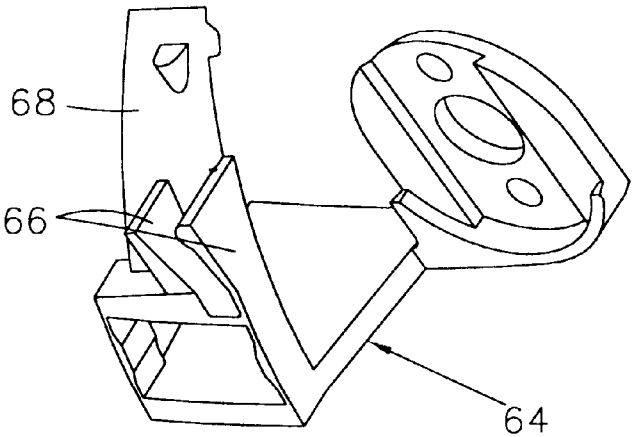
FIG. 25 is a front perspective view of the lever assembly.
Figure 26:
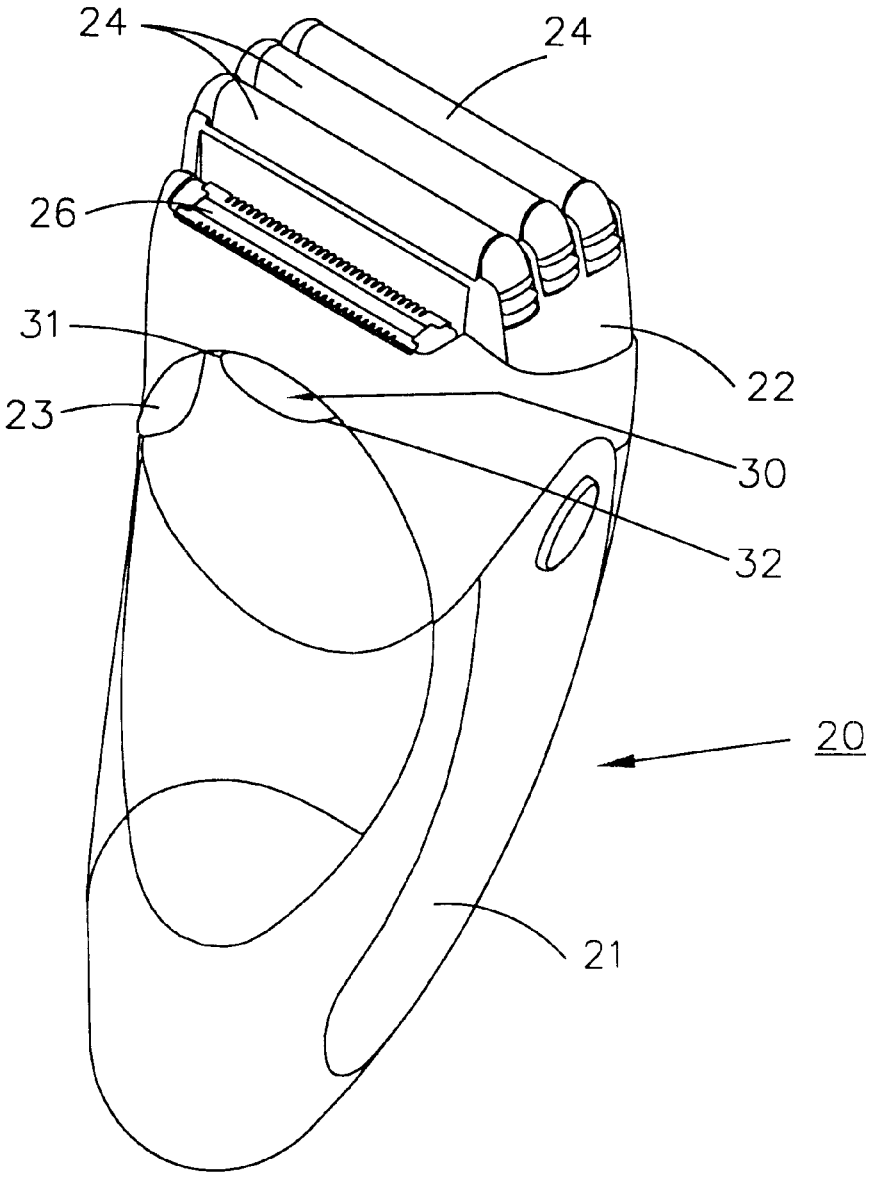
FIG. 26 is a perspective view of a second embodiment of the shaver system of the present invention.
Figure 27:
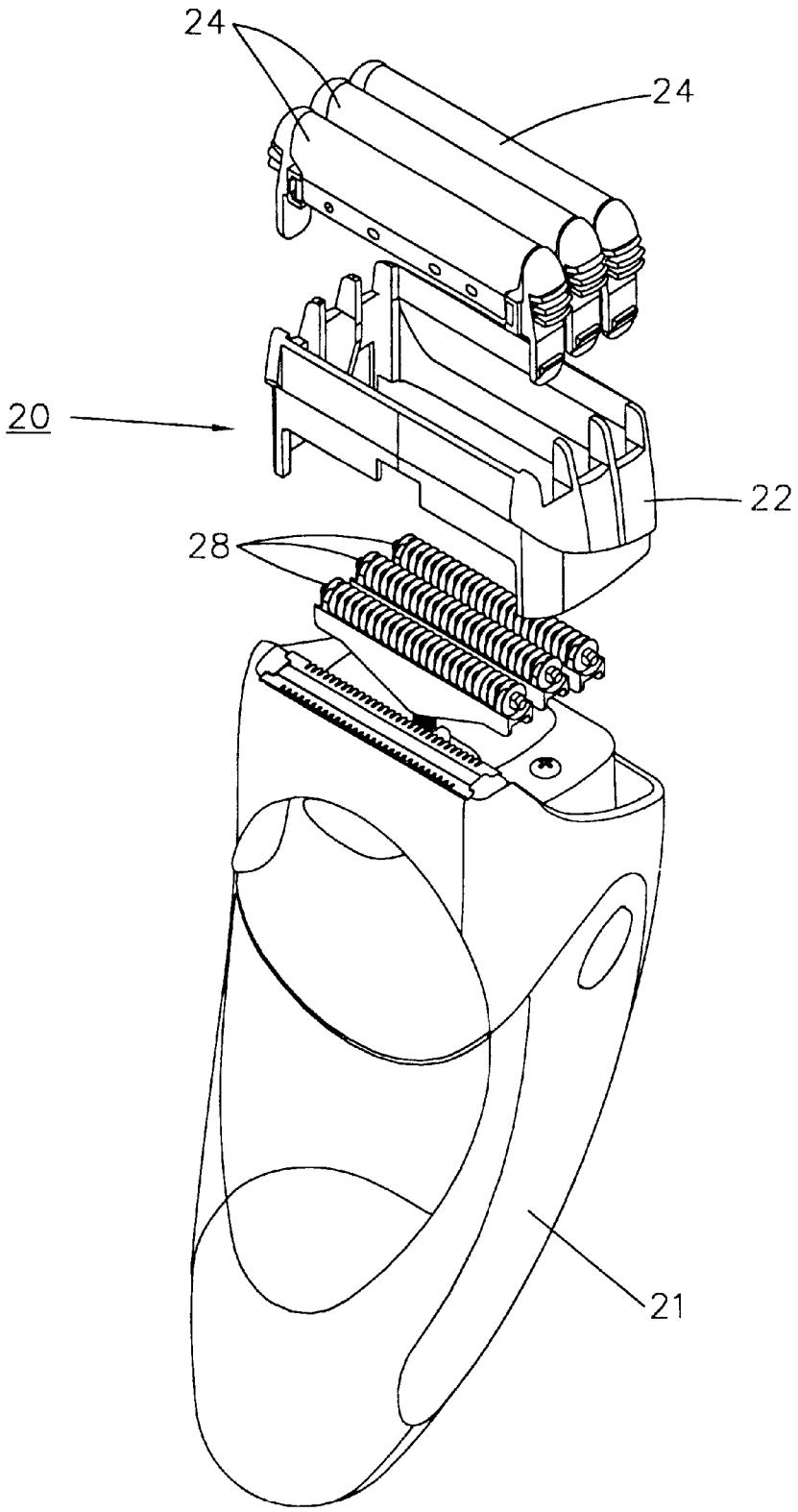
FIG. 27 is an exploded perspective view of this second embodiment of the shaver system of the present invention.
Figure 28:
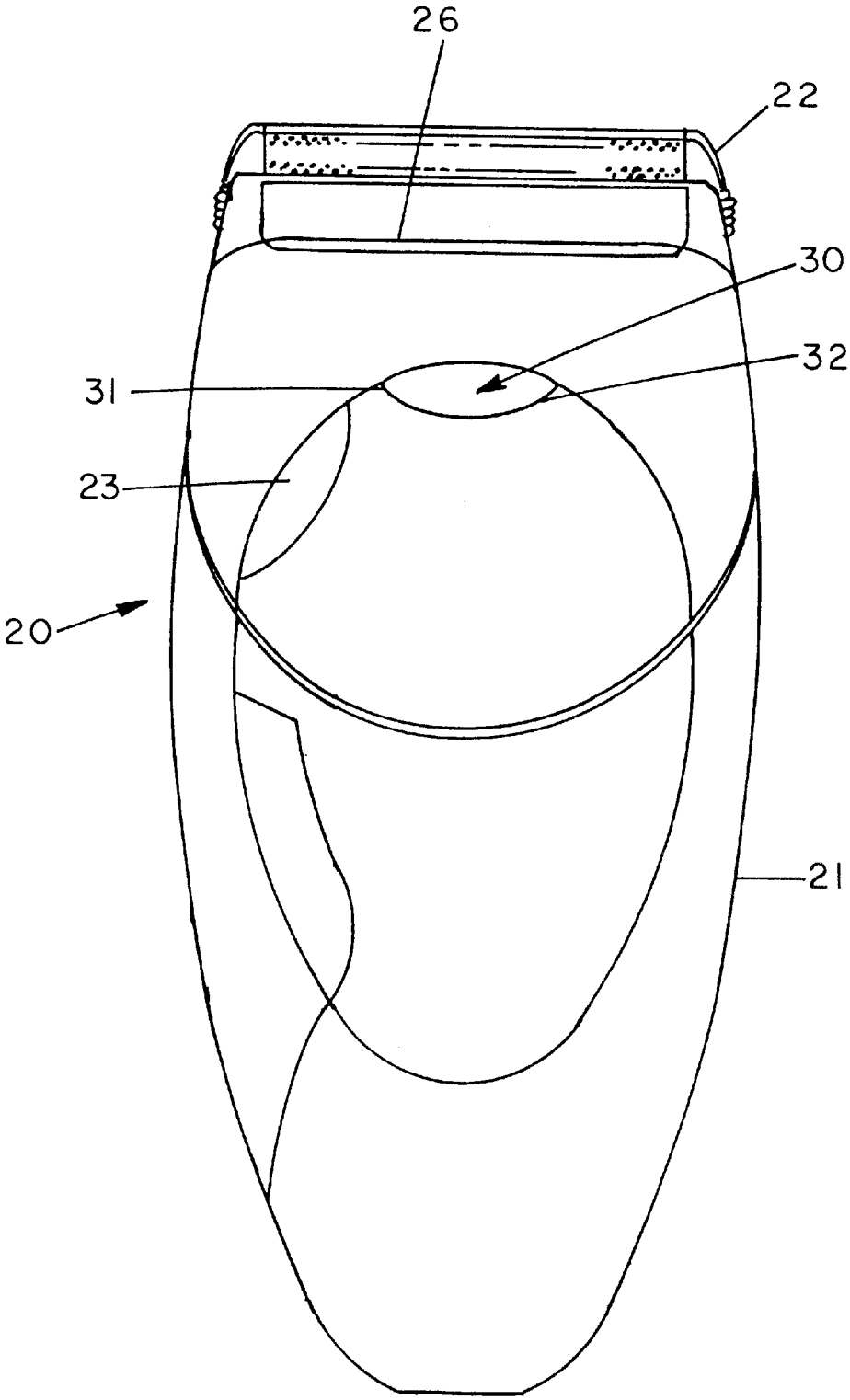
FIG. 28 is a front elevational view of this second embodiment of the shaver system of the present invention.
Figure 29:
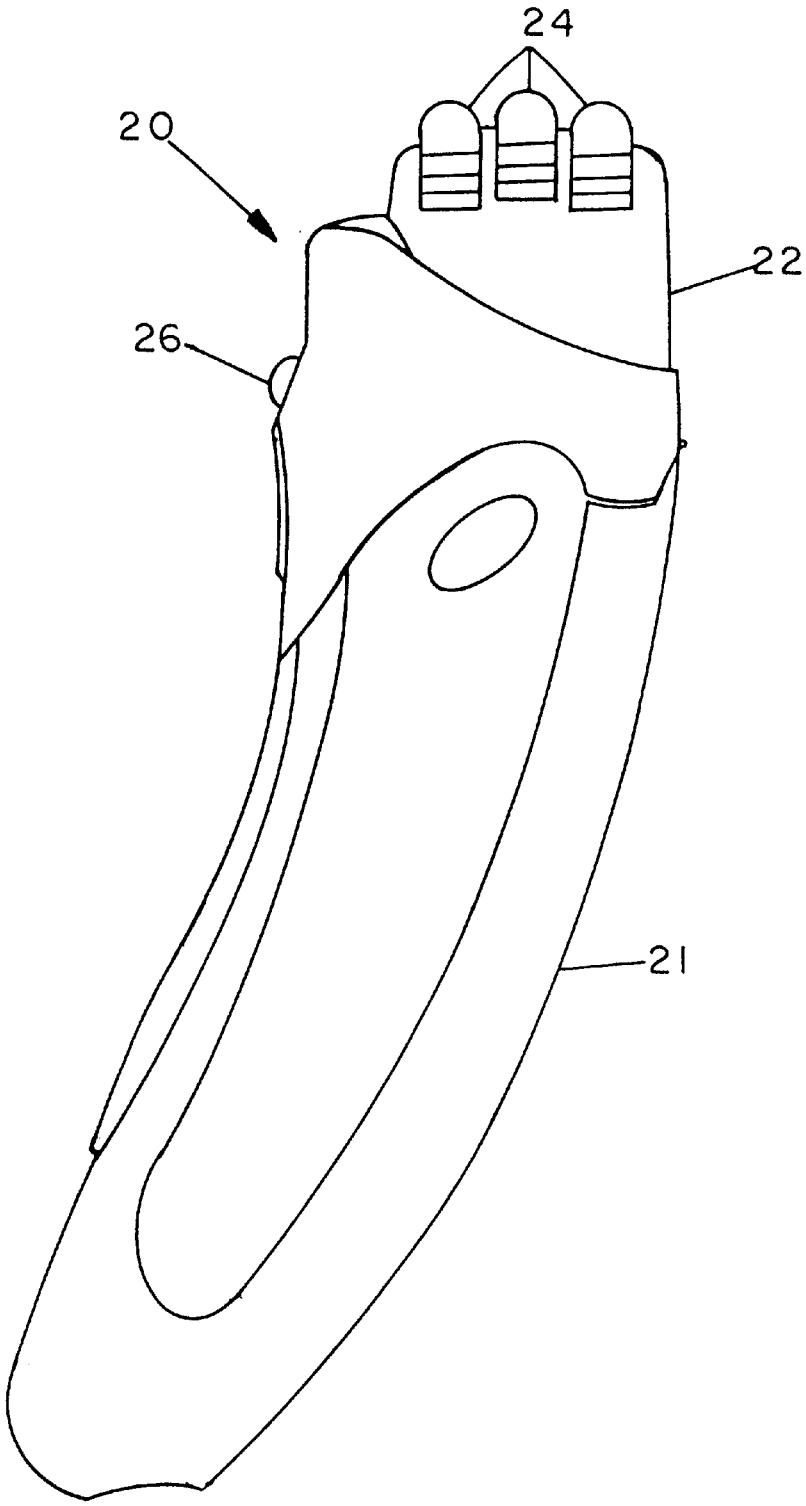
FIG. 29 is a side elevational view of this embodiment of the shaver system of the present invention.
Figure 30:
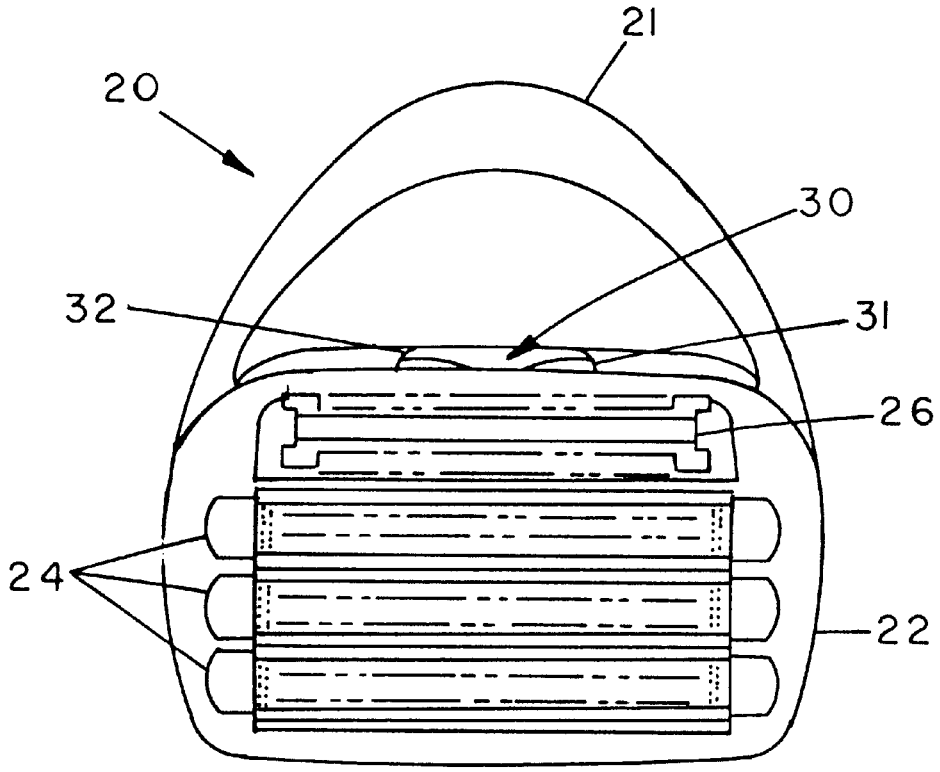
FIG. 30 is a top plan view of this embodiment of the shaver system of the present invention.
Figure 31:
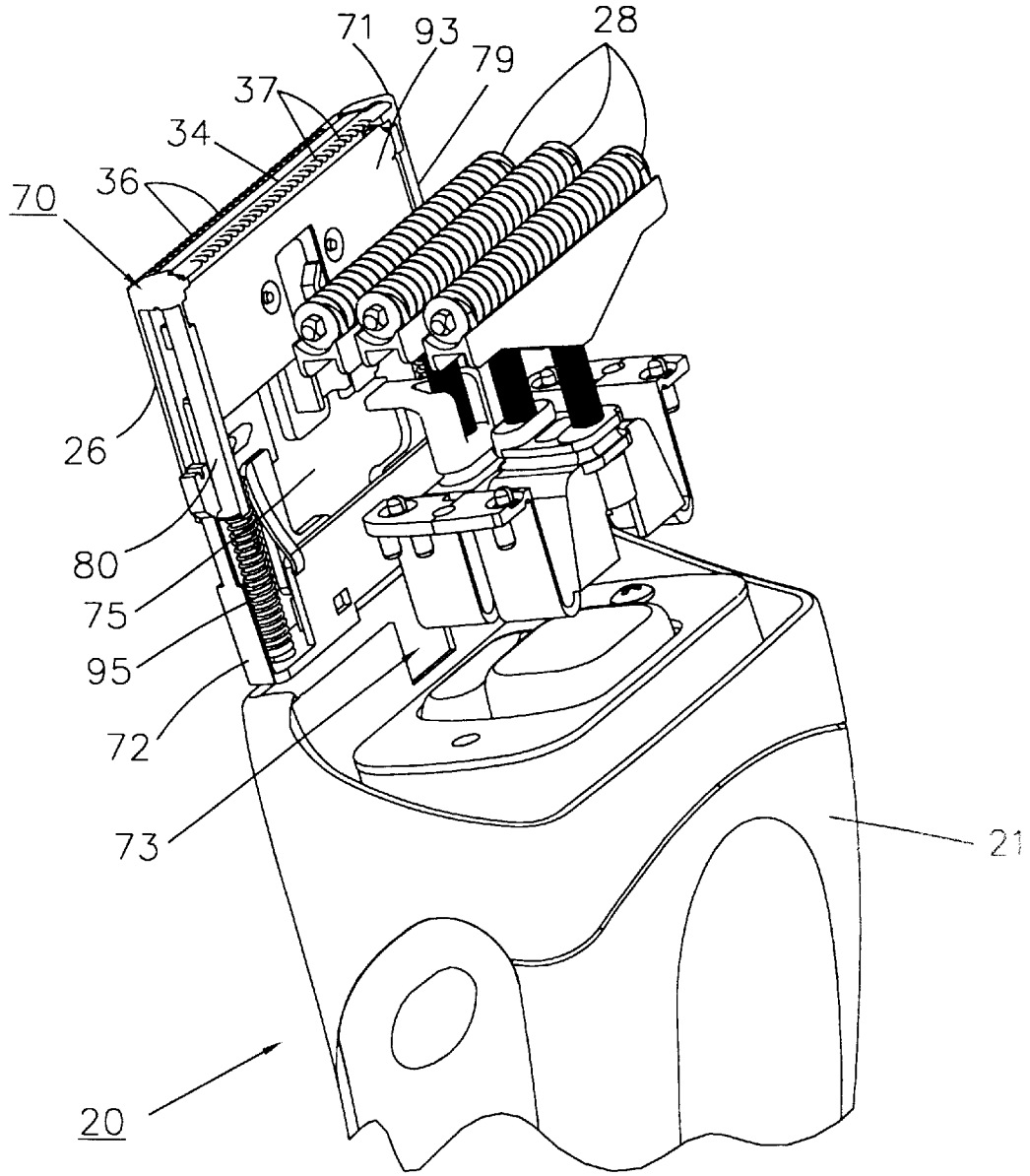
FIGS. 31–33 are fragmentary exploded perspective views of this embodiment of the shaver system of the present invention.

Furthermore, as shown in FIG. 23, wherein lever assembly 64 and activation switch 30 are viewed from the bottom thereof, movement of end 31 of switch 30 causes finger member 65 to move towards side edge 45 of housing 40. In addition, movement of end 32 of switch 30 causes finger member 65 to move towards edge 46 of housing 40.

Since this movement controls the movement of lever assembly 64, locking pin 69 on plate 68 moves towards edge 45 of housing 40 when end 31 of switch 30 is activated, while locking pin 69 on plate 68 moves towards edge 46 of housing 40 when end 32 of switch 30 is activated. Furthermore, since switch 30 is self-centering, continuously returning to its original position, locking pin 69 of lever assembly 64 is also self centering, continuously returning to its original position.

By employing this construction, the precisely desired, controlled, movement of trimmer assembly 26 is attained. As described, locking pin 69 is normally positioned in its self-centered position, in vertical alignment with ledge 61 in a manner which locks plate 40 of trimmer assembly 26 in its first, stored position. This position is maintained until the user desires to activate trimmer assembly 26 by moving activation switch 30.

Whenever end 31 of activation switch 30 is moved, the locking pin is moved out of vertical alignment with ledge 61 towards side edges 45 of plate 40. Once the locking pin is moved away from engagement with ledge 61, torsion springs 56 and 57 force housing 41 upwardly. This upward movement continues until the locking pin engages ridge 62. This position corresponds to the second, intercept position detailed above, thereby providing the desired direct movement of trimmer assembly 26 into the intercept position. As is evident from this detailed disclosure, the simple movement of end 31 of activating switch 30 causes trimmer assembly 26 to be quickly moved directly into its second, intercept position. Although locking pin 69 is self-centered, along with switch 30, the length of ridge 62 maintains locking pin 69 engaged therewith.

Whenever the user desires trimmer assembly 26 to be moved into its third, fully raised position, end 32 of switch 30 is activated causing the locking pin 69 associated therewith to be moved towards side edge 46 of plate 40. When trimmer assembly 26 is in its second, intercept position, the movement of the locking pin associated with switch 30 moves out of engagement with ridge 62, thereby allowing plate 40 to be raised to its fully extended position, with pin 69 contacting the base of recess zone 60. When in this position, trimmer assembly 26 is in the third position.

Furthermore, when the locking pin associated with switch 30 is in engagement with ledge 61, the movement of end 32 of switch 30 causes the locking pin to be disengaged from ledge 61, enabling torsion springs 56 and 57 to move plate 40 of trimmer assembly 26 from its first position directly into its third, fully raised position, with the pin contacting the base or bottom edge of recess zone 60.

By employing this construction, the desired floating or vertically flexible movement of trimmer assembly 26 is attained when in its second or intercept position. As fully detailed above, activation switch 30 is self-centered, along with locking pin 69. Consequently, when trimmer assembly 26 is in its intercept position, locking pin 69 of lever 64 is positioned between ledge 61 and ridge 62.

Since torsion springs 56 and 57 continuously urge housing 40 upwardly, causing locking pin 69 to contact ridge 62, pin 69 is free to move upwardly towards ledge 61 whenever force is applied to the top edge of housing 40. Consequently, flexible vertical movement of floating action is attained as the user operates shaver system 20 over the various contours of his face. In this way, the desired optimum shaving of long and short hair fibers is realized.

By referring to FIGS. 26–50, along with a following detailed discussion, the preferred construction and operation of trimmer assembly 26 in the second embodiment of shaver system 20 of the present invention can best be understood. In this embodiment, as fully detailed, trimmer assembly 26 comprises a substantially flat cartridge 70 which incorporates cooperating housing members 71 and 72 movably mounted relative to each other.

In the preferred embodiment, cartridge 70 which forms trimmer assembly 26 is inserted into a vertical pocket or receiving zone 73 formed in housing 21 of shaver system 20. Preferably, zone 73 is molded in housing 21 to be completely external to the major sealed enclosures of shaver system 20. In this way, this embodiment of shaver system 20 is capable of being exposed to water, with all electrical portions thereof completely sealed from any exposure to the water.

In FIGS. 26–30, each of the components forming shaver system 20 are fully detailed. In addition each of these components which are common to both preferred embodiments of shaver system 20 have been fully described above, the disclosure of which is reiterated and incorporated herein by reference.

Dealing with the specific, unique features of construction and operation of this embodiment of shaver system 20 of the present invention, reference should first be made to FIGS. 34–36 and 43, wherein the first, stored position of trimmer assembly 26 in pocket 73 of housing 21 of shaver 20 is fully depicted. In this position, trimmer assembly 26 is maintained in a position below apertured foils/mesh screens 24 and cutting blades 28. In this position, trimmer assembly 26 is not operational, thereby allowing mesh screens 24 and cutting blades 28 to be employed for providing the desired shaving.

In its preferred construction, as discussed above with the other embodiment, trimmer assembly 26 comprises fixed cutting blade member 34 and movable cutting blade member 35, which is mounted in cooperating, sliding engagement with blade member 34. In the preferred construction, cutting blade members 34 and 35 are mounted along the top edge of trimmer assembly 26, with blade member 35 interconnected with a movement control arm which is drivingly engaged with the motor for attaining the desired side to side, reciprocating movement.

In addition, cutting blade members 34 and 35 each incorporate a forwardly extending row of cutting teeth 36 and a rearwardly extending row of cutting teeth 37. By mounting blade members 34 and 35 in sliding cooperating engagement with each other, with cutting teeth 36 and 37 of each blade member being maintained in cooperating, sliding engagement with each other, the movement of blade member 35 relative to blade member 34 enables the cutting teeth thereof to provide the desired cutting action. In this way, the desired trimming of the longer hair fibers is achieved.

As discussed above, when trimmer assembly 26 is in its first, stowed position, movement of cutting blade member 35 is not required, since trimmer assembly 26 is positioned away from the skin surface of the user. As a result, as further detailed below, in the preferred construction, cutting blade member 35 remains idle when in this position.

Whenever the user wishes to activate trimmer assembly 26 into its second, intercept position, end 31 of trigger activation switch 30 is moved, causing trimmer assembly 26 to automatically move from the stored position into the desired second or intercept position. This second position is clearly depicted in FIGS. 37–39 and 44.

In this position, cutting blade members 34 and 35 of trimmer assembly 26 are aligned with the closest apertured foil 24 for providing cooperating, cutting action therewith. In this position, cutting blade members 34 and 35 of trimmer assembly 26 are capable of cooperating with apertured foils 24 and cutting blade assemblies 28 to assist in cutting longer hair fibers simultaneously with the cutting of the shorter hair fibers by apertured foils 24 and cutting blade assemblies 28.

By providing simultaneous cutting of long hair fibers and short hair fibers, as well as the initial trimming of hair fibers by trimmer assembly 26 followed by closer shaving of the hair fiber by apertured foils 24 and cutting blade assemblies 28, a user is able to effectively shave any desired length of hair fiber. Such mixed hair fiber length are typically encountered in a beard after the hair fibers have been allowed to grow for one or more days.

Whenever a user wishes to separately trim any desired area, such as side burns, mustaches, etc., independently of the apertured foils 24 and 32 of activation switch 30 is moved, causing trimmer assembly 26 to automatically move into the third alternate position. In this position, depicted in FIGS. 40–42 and 45, trimmer assembly 26 is raised above apertured foils 24. In the preferred embodiment of the present invention, as detailed below, trimmer assembly 26 automatically moves into the third position from either the stored position or the intercept position whenever end 32 of activation switch 30 is moved.

When trimmer assembly 26 is placed in its third alternate position, cutting blade members 34 and 35 of trimmer assembly 26 are positioned in a readily accessible location for enabling cutting blade members 34 and 35 to be employed in any desired manner for cutting or trimming longer hair fibers, such as found on mustaches, beard edges, and sideburns, independently of apertured foils 24. In this way, a convenient, more precise trimming function is achieved.

By referring to FIGS. 31–33 and 46–55 along with the following detailed disclosure, the preferred construction of two alternate embodiments of trimmer assembly 26 can best be understood. In the preferred constructions of these embodiments, trimmer assembly 26 incorporates cartridge 70 which comprises housing members 71 and 72. Preferably, housing member 72 is fixedly mounted in receiving zone or pocket 73 of housing 21 of shaver system 20, while housing member 71 is also mounted in pocket 73, vertically movable relative to housing member 72 and pocket 73. In addition, housing member 71 comprises inside surface 75, outside surface 76, top or upper edge 77, bottom edge 78, and side sides 79 and 80.

As discussed above, trimmer assembly 26 incorporates fixed, stationary, cutting blade member 34 which is mounted along the top edge 77 of housing member 71, extending substantially the entire length thereof. Furthermore, fixed, stationary cutting blade member 34 incorporates a forwardly extending row of cutting teeth 36 and a rearwardly extending row of cutting teeth 37, both of which extends substantially the entire length of cutting blade member 34.

In order to attain the desired hair cutting action, trimmer assembly 26 also incorporates movable cutting blade member 35 which is mounted in cooperating interengagement with fixed cutting blade member 34. Movable cutting blade member 35 also incorporates a forwardly extending row of cutting teeth 36 and a rearwardly extending row of cutting teeth 37, both of which are aligned with and cooperatingly associated with the respective cutting teeth of blade member 34. Furthermore, in order to assure that movable cutting blade member 35 is maintained in contact with fixed cutting blade member 34, spring means 84 and 85 are employed and positioned for continuously forcing or biasing movable cutting blade member 35 upwardly into contacting engagement with fixed cutting blade member 34.

In order to provide the desired controlled, side to side, reciprocating movement of cutting blade member 35 relative to fixed, stationary cutting blade member 34, trimmer assembly 26 incorporates slider 86 mounted to inside surface 75 of housing member 71. In the preferred embodiment, slider 86 is interconnected to blade member 35 for controlling and providing the desired, side to side movement of blade member 35. In addition, slider 86 incorporates outwardly extending arms 87 and 88 which are retained in holding clips 89 affixed to inside surface 75 of housing member 71 and constructed to enable lateral movement of slider 86. Furthermore, arms 87 and 88 of slider 86 also incorporate a support post for retaining spring means 84 and 85 in a manner which enables the biasing engagement of blade member 35 to be attained. By employing this construction, slider 86 is free to move sideways between side edges 79 and 80 of cartridge 70, while also being movable in the precisely desired controlled manner.

In order to impart the desired movement to slider 86, slider 86 incorporates an elongated, open Y-shaped channel 90 which is constructed for being positioned in controlled engagement with a drive pin associated with the drive system which controllably moves cutting blade assemblies 28. The construction of Y-shaped channel 90 assures that slider 86 is continuously moved in the desired side to side manner whenever trimmer assembly 26 is in its second or third position. However, by incorporating enlarged open zone 91 at the top of Y-shaped channel 90, the movement of the drive pin associated with the cutting blade assemblies 28 merely moves in its normal manner, without affecting the movement of slider 86 when trimmer assembly 26 is in its stored position. In this way, whenever trimmer assembly 26 is in its first, stored position, slider 86 does not move and cutting blades 34 and 35 remain idle.

In order to complete the overall construction of trimmer assembly 26, a substantially flat cover plate or shield 93 is employed for overlying slider 86 and all of its associated components, thereby protecting these components from dust, dirt, and debris. In addition, movement controlling spring members 94 and 95 are mounted at the base of housing member 72 extending therefrom into movement controlling engagement with housing member 71. Spring members 94 and 95 control the upward movement of housing member 71 relative to housing member 72 in response to the movement of control switch 30.

In addition, as detailed above, whenever trimmer assembly 26 is to be returned to its original, stored position, manual movement of trimmer assembly 26 is employed. In this way, the spring forces being exerted by spring members 94 and 95 are overcome, and trimmer assembly 26 is returned to its first, stored position.

In order to provide the desired controlled movement of trimmer assembly 26, in accordance with the teaching of the present invention, wherein trimmer assembly 26 is capable of being moved directly from its first, stored position into either its second, intercept position or its third, fully raised position, a unique movement control system is employed. By referring to FIGS. 31–33 and 46–55, along with the following detailed discussion, two alternate constructions of trimmer assembly 26 for this embodiment of shaver system 20 of the present intention can best be understood.

Figure 32:
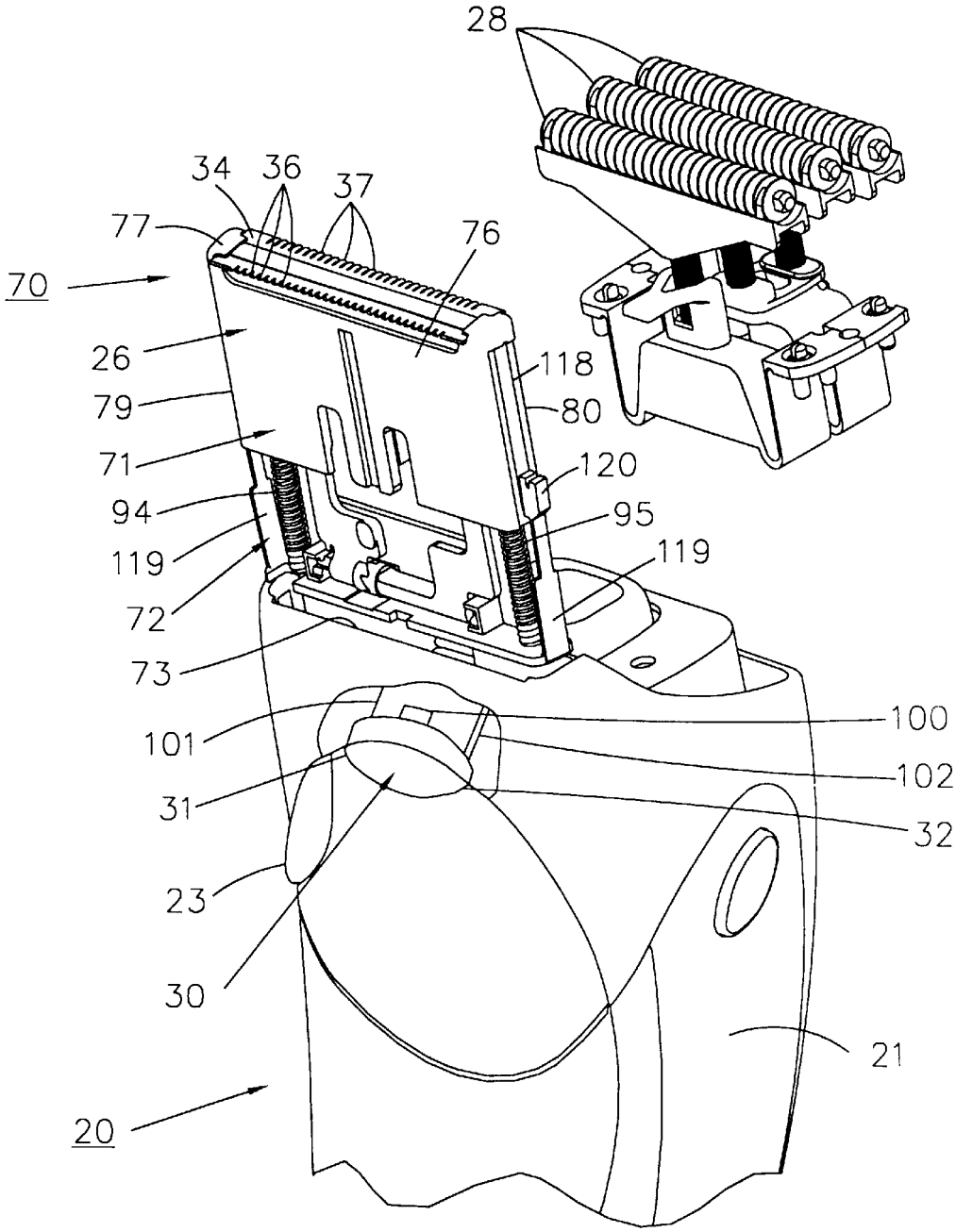
Figure 33:
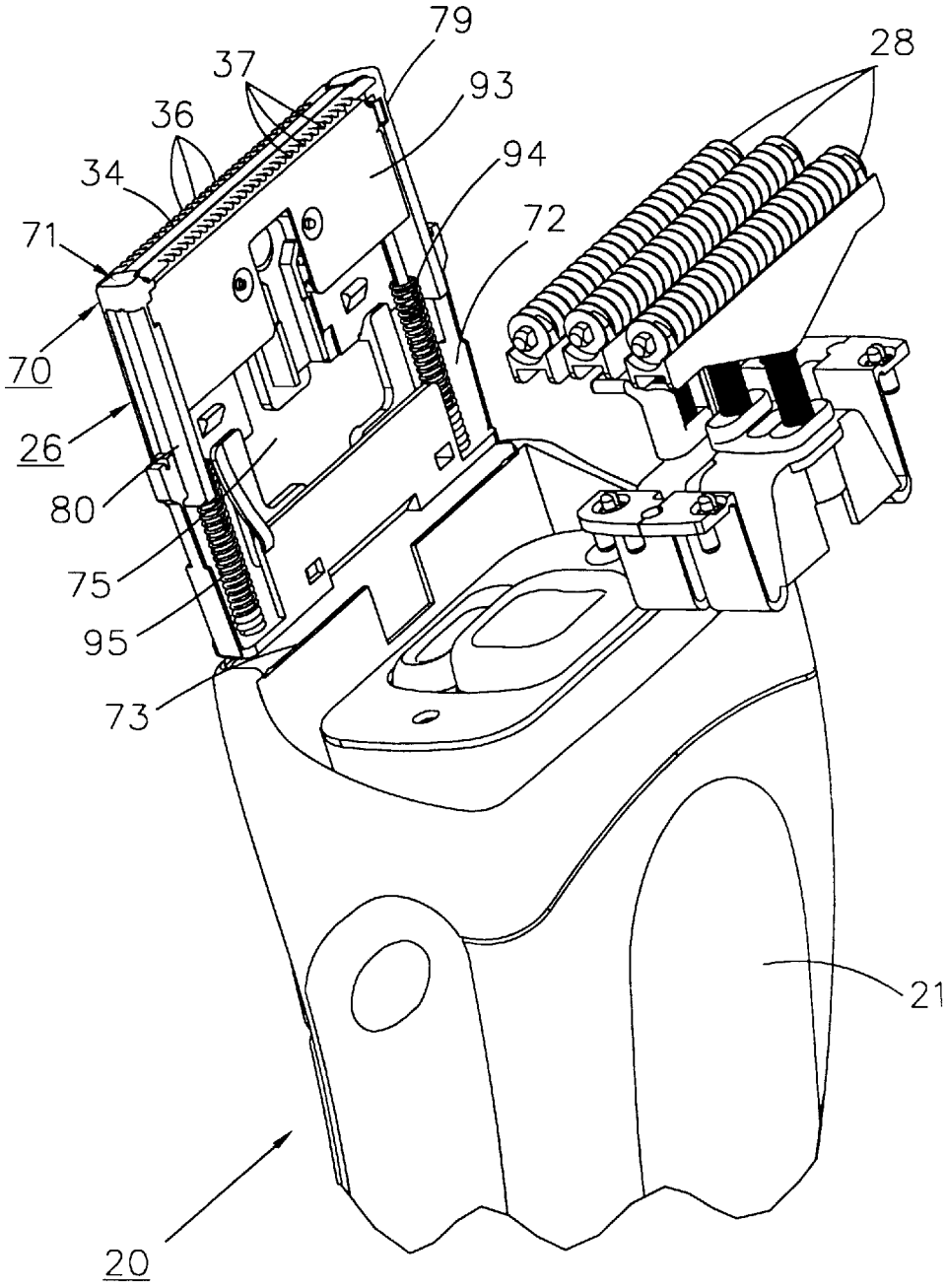
Figure 36:
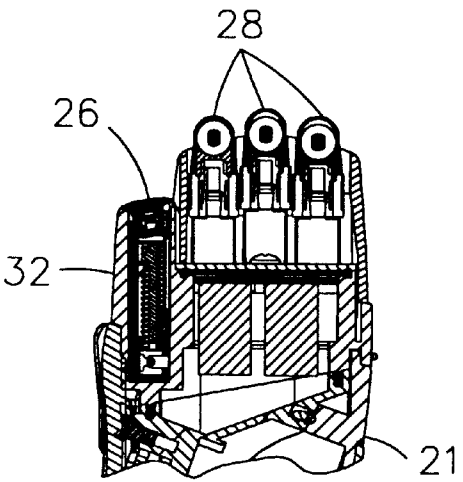
FIGS. 34–42 are front and cross-sectional side elevational views of this embodiment of the shaver system of the present invention depicting the trimmer assembly in its alternate positions.
Figure 35:
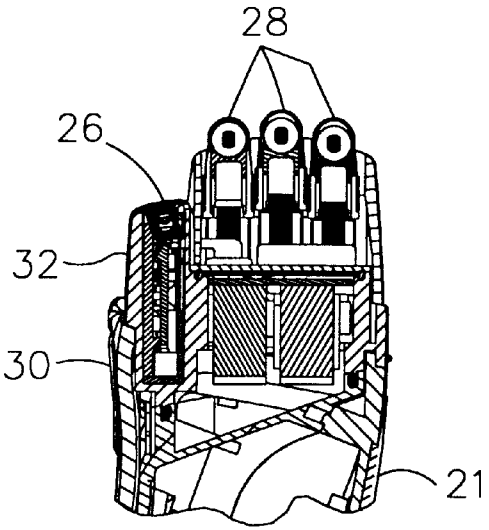
Figure 34:
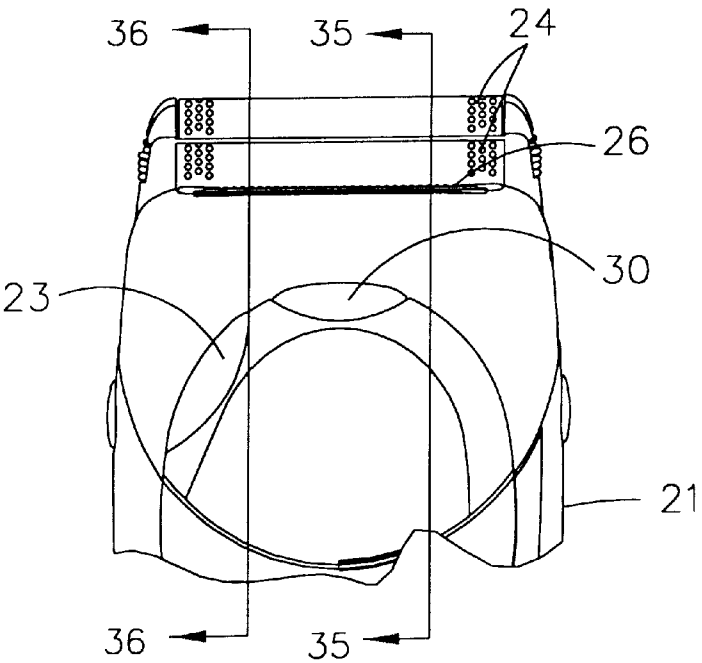
Figure 39:
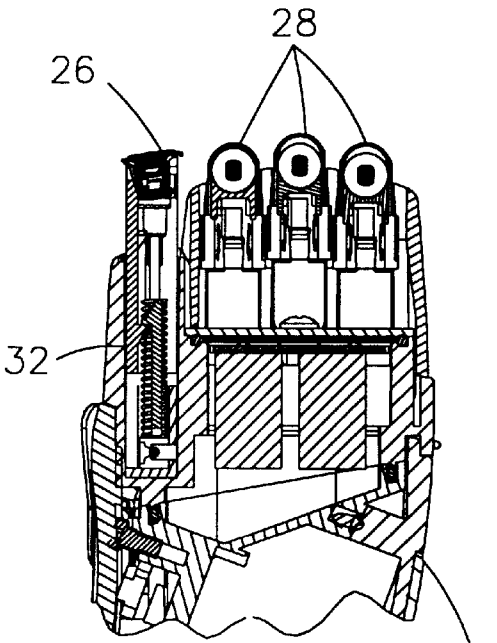
Figure 38:
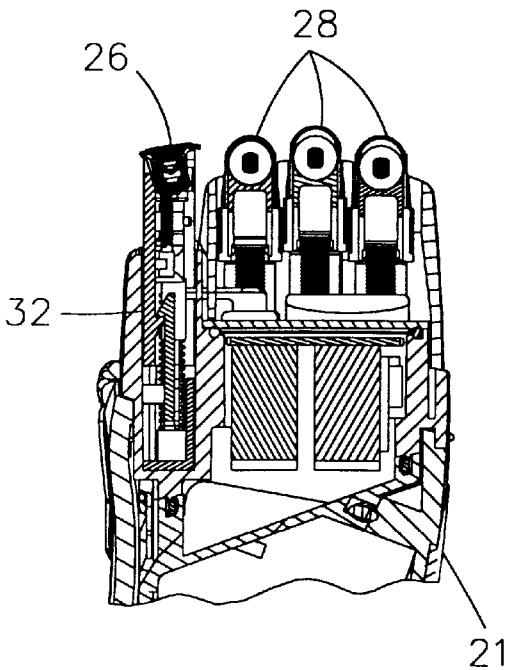
Figure 37:
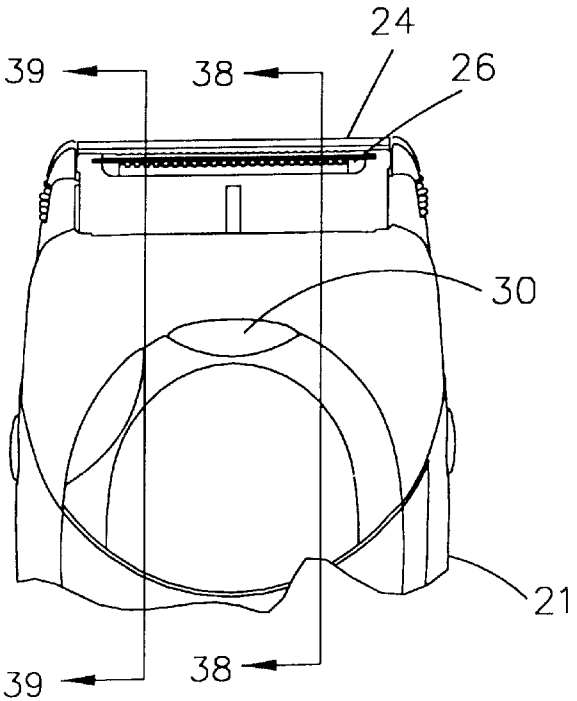
Figure 42:
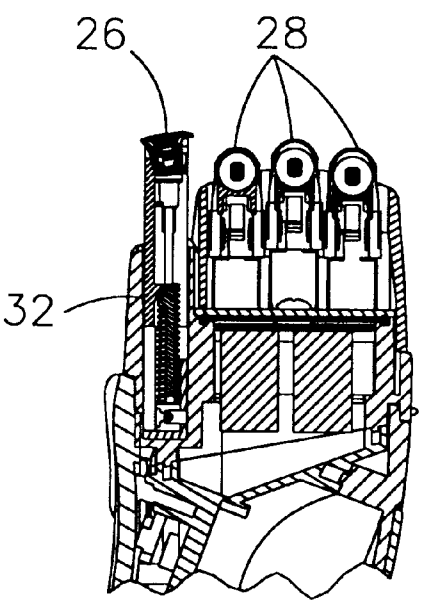
Figure 41:
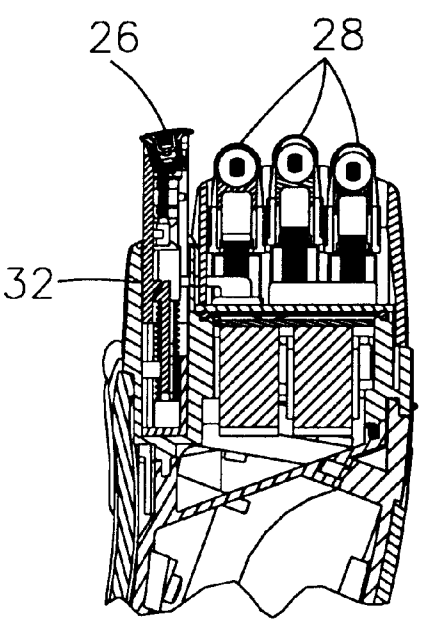
Figure 40:
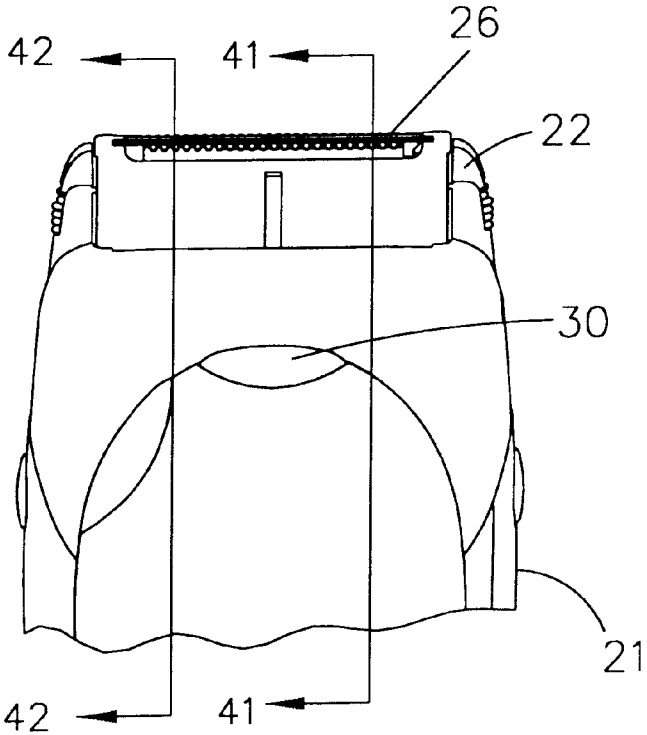
Figure 45:
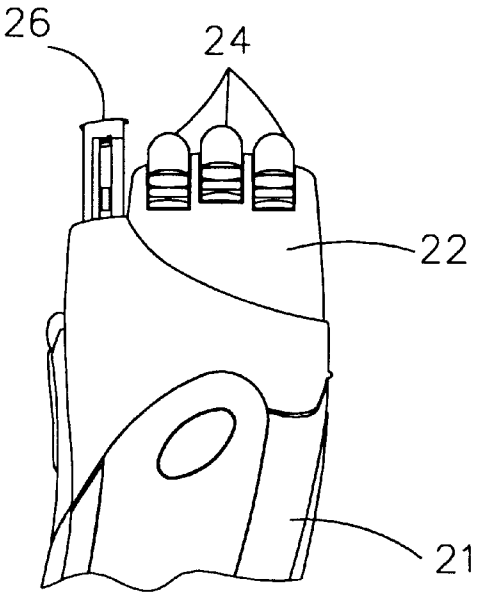
FIGS. 43–45 are side elevational views of this embodiment of the shaver system of the present invention depicting the trimmer assembly in its three alternate positions.
Figure 44:
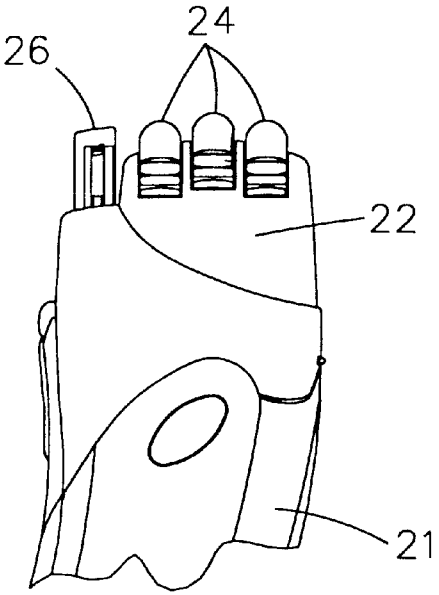
Figure 43:
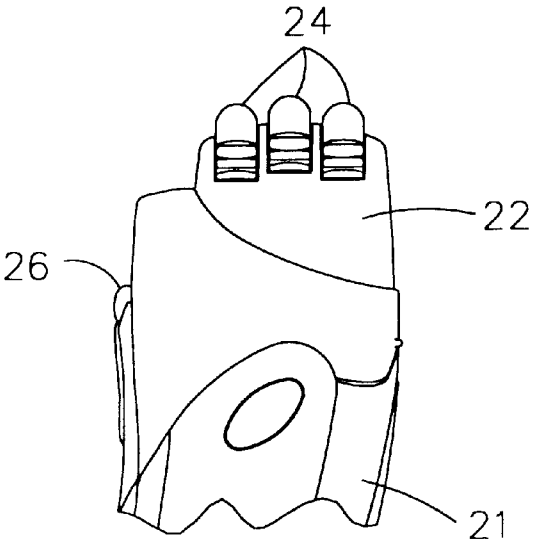

As shown in FIG. 32, activation switch 30 comprises a three-position rocker switch mounted to housing 21 of shaver system 20 for rocking or pivoting movement about pivot pad 100. In addition, activation switch 30 incorporates longitudinally extending pins 101 and 102 which extend from the rear surface of switch 30 into housing 21 of the shaver system 20. By employing this construction, whenever end 31 of switch 30 is pressed, pin 101 moves rearwardly into engagement with the trimmer assembly 26, while movement of end 32 of switch 30 causes pin 102 to move rearwardly, into engagement with trimmer assembly 26.

In both constructions of this embodiment of trimmer assembly 26, cartridge 70 is constructed with housing member 71 controllably movable relative to housing member 72 by employing movable, pivot arms 104 and 105, in combination with ledges 106, 107, and 108. As detailed above, the movement of housing member 71 relative to housing member 72 is provided by spring means 94 and 95. However, by employing arm members 104 and 105 in combination with ledges 106, 107, and 108, the controlled movement of housing member 71 relative to housing member 72 between its three alternate positions is attained.

As depicted, ledges 106, 107 and 108 are each formed extending from inside surface 75 of housing member 71, with each ledge comprising a substantially flat, top surface 110, and a sloping rear surface 111 which extends from the terminating end of top surface 110 to inside surface 75, forming a ramp zone. In addition, each arm member 104 and 105 comprises a terminating end 113, which incorporates a sloping, ramped rear wall portion 114 extending from terminating end 113 a fixed distance. Furthermore, a substantially flat locking surface 115 extends from the base of sloping wall portion 114 substantially perpendicularly to the side of the arm member.

In the preferred constructions, ledge 106 is vertically aligned with ledge 108, while ledge 107 is horizontally aligned with ledge 108. As a result of this construction, pivot arm 104 lockingly engages ledges 106 and 108, while pivot arm 105 lockingly engages only ledge 107. Furthermore, as is fully detailed below, pivot arms 104 and 105 are spring biased towards rear wall 75 of housing member 71, for maintaining interengagement with ledges 106, 107, and 108 until physically removed therefrom.

Using the construction detailed above, cartridges 70, forming trimmer assembly 26, is maintained in its first, stored position by the engagement of pivot arm 104 with ledge 106. When in this first, stored position, flat locking surface 115 of arm 104 is in overlying, locking engagement with flat top surface 110 of ledge 106. Since arm 104 is spring biased, this position is maintained until an outside force acts upon arm 104.

Similarly, cartridge 70 is maintained in its second, intercept position by the engagement of pivot arms 104 and 105 with ledges 107 and 108. Since ledges 107 and 108 are horizontally aligned with each other and each pivot arm comprises the same overall length, the second, intercept position is maintained by the engagement of flat locking surface 115 of pivot arms 104 and 105 with the flat top surface 110 of ledges 108 and 107. Furthermore, with pivot arms 104 and 105 both spring biased towards inside surface 75 of housing member 71, cartridge 70 is maintained in the second, intercept position, once established, until pivot arms 104 in 105 are acted upon by an outside force.

And as is more fully detailed below, pivot arms 104 and 105 move in response to movements of activation switch 30. In this regard, by moving switch 30 from its rest position into either of its two alternate activation positions, the desired controlled movement of pivot arms 104 and 105 is attained for controllably activating cartridge 70 of trimmer assembly 26 to move from its first, stored position directly into either its second, intercept position or its third, fully extended, trim position. In addition, as discussed above, whenever cartridge 70 is to be returned from either its second or third position back to its first, stored position, manual movement of housing member 71 relative to housing member 70 to is employed.

Due to the construction of pivot arms 104 and 105 and ledges 106, 107 and 108, smooth, trouble-free movement of cartridge 70 from its second or third positions into its first position is attained whenever housing member 71 is manually moved downwardly into engagement with housing member 72. In this regard, whenever pivot arms 104 and 105 are disengaged from locked engagement with ledges 106, 107, and 108, movement of housing member 71 downwardly, relative to housing member 72 causes the sloping, ramped rear wall 114 of pivot arms 104 and 105 to contact sloping rear surface 111 of ledges 106, 107, or 108.

Due to the complementary, cooperating slope angle provided by these surfaces, the downward movement of housing member 71 causes sloping, rear surface 111 of ledges 106, 107 or 108 to contact sloping, ramped, rear wall 114 of arm members 104 or 105. As the downward movement continues, sloping surfaces 111 and 114 advance into engagement with each other, causing arm members 104 and/or 105 to be cammed outwardly against the spring biasing forces so as to enable arm members 104 and/or 105 to move past ledges 106, 107, or 108. In this way, the desired movement of housing member 71 relative to housing member 72 is easily attained.

Although various alternate constructions can be employed for maintaining housing member 71 in its third, fully raised, position, the preferred embodiment employs elongated slots 118 formed in side edges 79 and 80 of housing member 71 which are constructed for cooperating with lever 119 and locking tab 120 formed on the distal end of lever 119. As depicted, when housing member 71 is fully assembled with housing member 72, locking tabs 120 are slidably engaged within elongated slots 118, freely movable therein between the terminating ends of slots 118. However, whenever locking arms 104 and 105 have been disengaged from ridges 107 and 108, spring members 94 and 95 advance housing member 71 upwardly until locking tabs 120 contact the terminating ends of slots 118. This position represents the third, fully raised position for cartridge 70.

In addition to providing the desired movement of cartridge 70 between its three alternate positions, the construction employed in this embodiment of the present invention also enables housing member 71 to be floating or movable relative to housing member 72 when cartridge 70 is in the intercept position. As detailed above, in this position arm members 104 and 105 are maintained in locked engagement with ridges 107 and 108 to establish the second, intercept position.

With spring members 94 and 95 continuously urging housing member 71 upwardly, away from housing member 72, the engagement of flat surfaces 115 and 110 counteract the spring forces and prevent the movement of housing member 71 in the upward direction. However, any downward force exerted on housing member 71 is able to move housing member 71 relative to housing member 72.

As a result, the desired floating movement of housing member 71 relative to housing member 72 is attained. Furthermore, when cartridge 70 is in the intercept position, spring members 94 and 95 continuously return housing member 71 to the intercept position with arms 104 and 105 engaged with ledges 107 and 108. As a result, substantially improved and enhanced shaving of longer hair fibers with shorter hair fibers is realized.

As is evident from the foregoing detailed discussion, in this embodiment of the present invention, cartridge 70 provides the desired locked engagement of housing member 71 in three alternate positions relative to housing member 72. Furthermore, as is fully detailed below, housing member 70 is capable of being moved from its first, stored position directly into any of the other two desired positions. In this regard, housing member 71 may be moved from the first, stored position directly into either the second, intercept position or directly into the third fully raised position. In addition, whenever housing 71 is in the second, intercept position, movement directly into the third, fully raised position can also be easily achieved.

In order to provide this unique, user controlled, direct position selection, activation switch 30 is employed in combination with a uniquely constructed control mechanism formed in cartridge 70. Although various alternate configurations can be developed for achieving this result, two alternate control mechanisms have been created and are fully disclosed herein.

Figure 47:
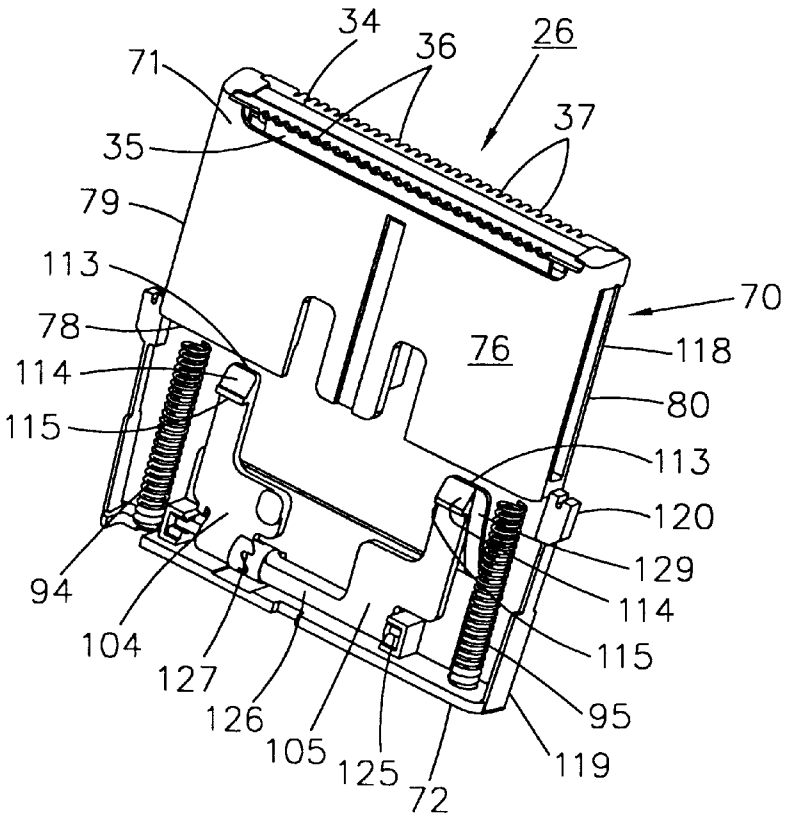
FIGS. 46 and 47 are front perspective views of an alternate embodiment for the trimmer assembly of the present invention for mounting in the shaver system of FIG. 26.
Figure 46:
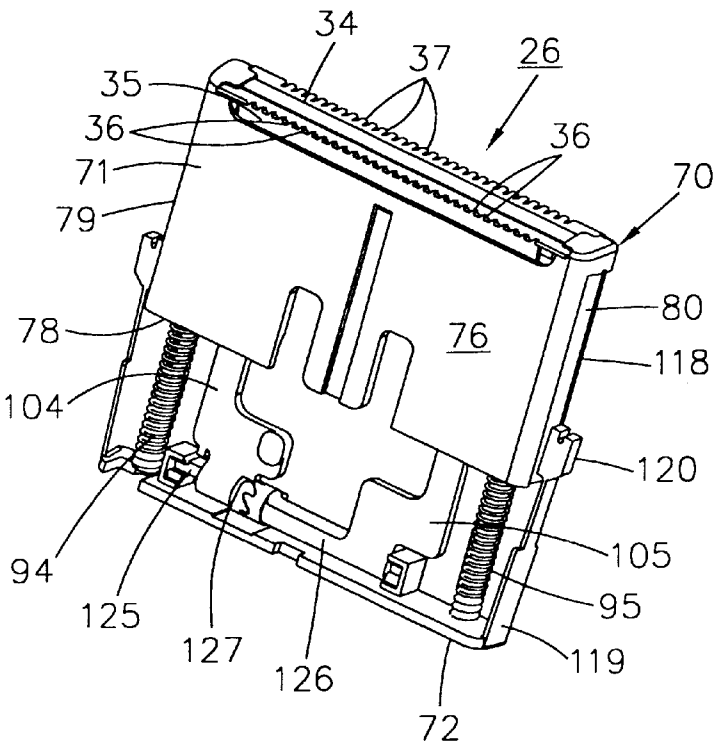
Figure 49:
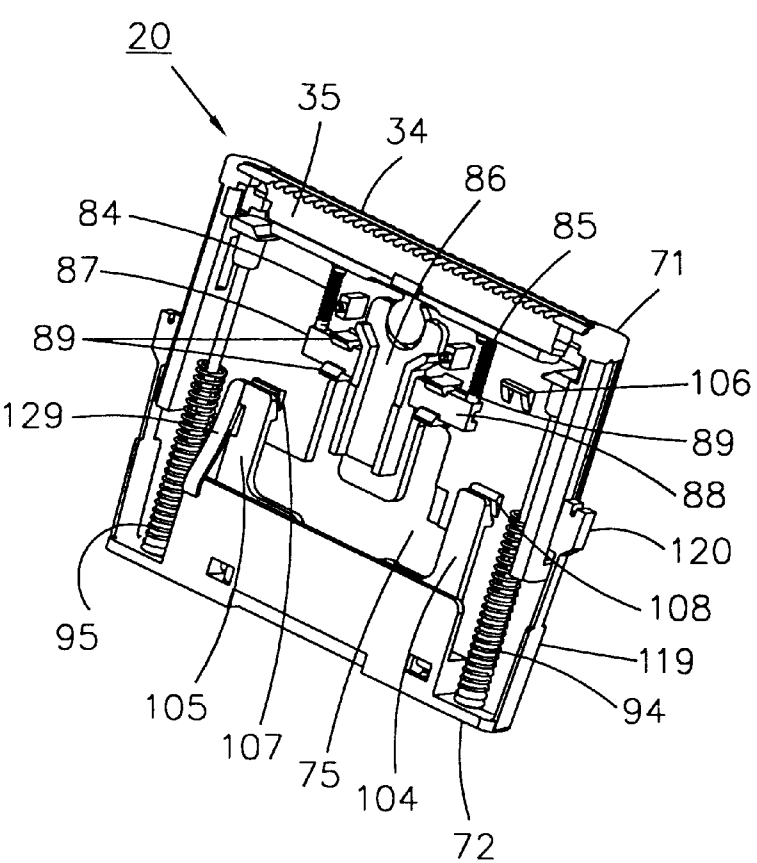
FIGS. 48 and 49 are rear perspective views of the trimmer assembly of FIG. 26 depicting the various components incorporated therein.
Figure 48:
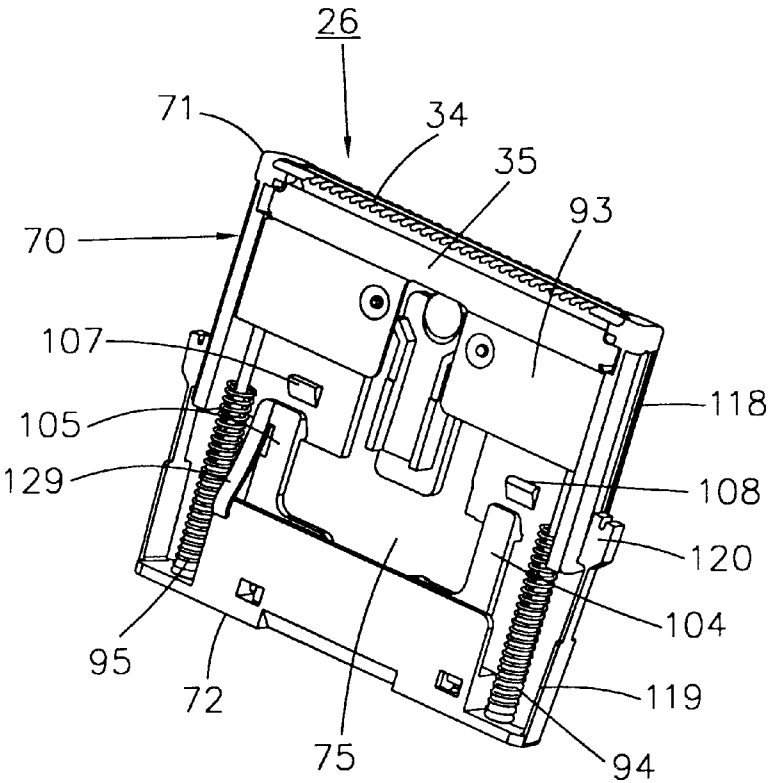
Figure 50:
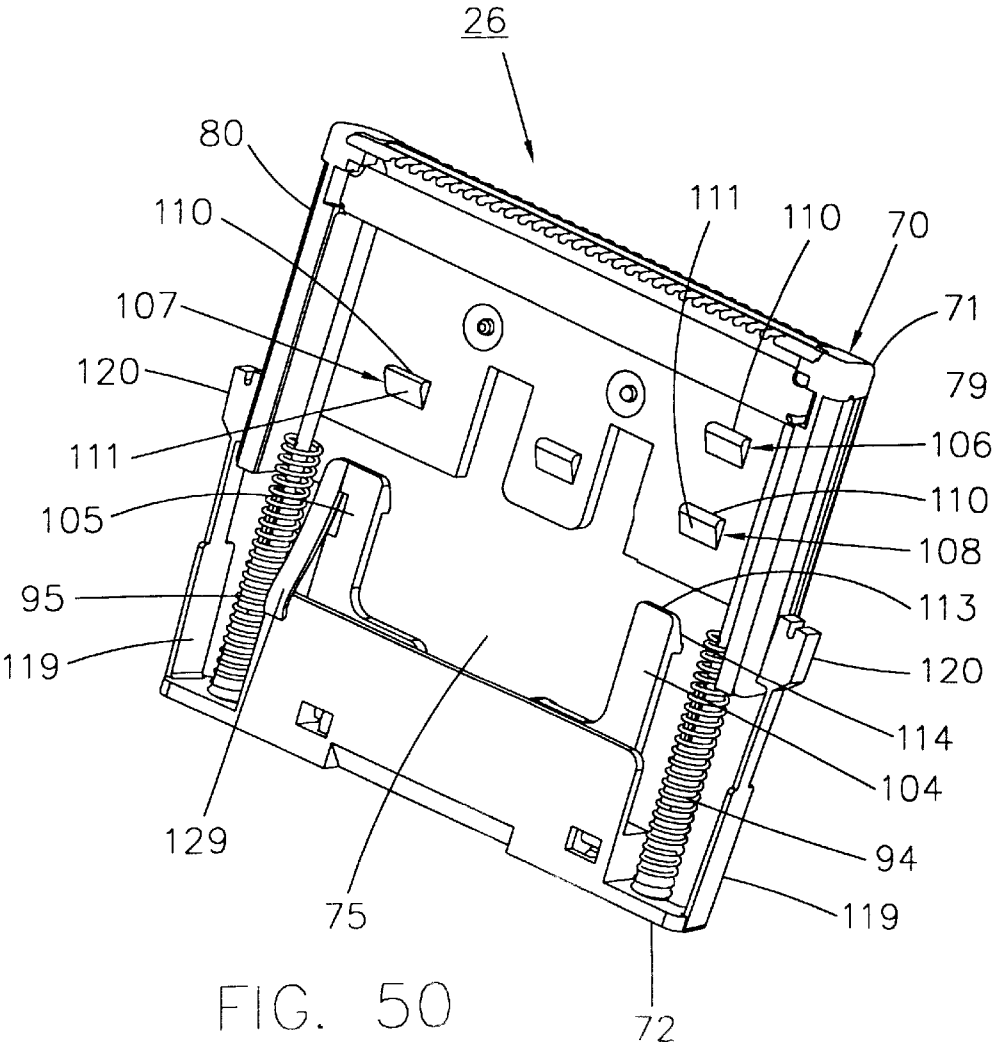
FIG. 50 is a rear perspective view of the trimmer assembly of FIG. 26 shown with some components removed.
Figure 51:
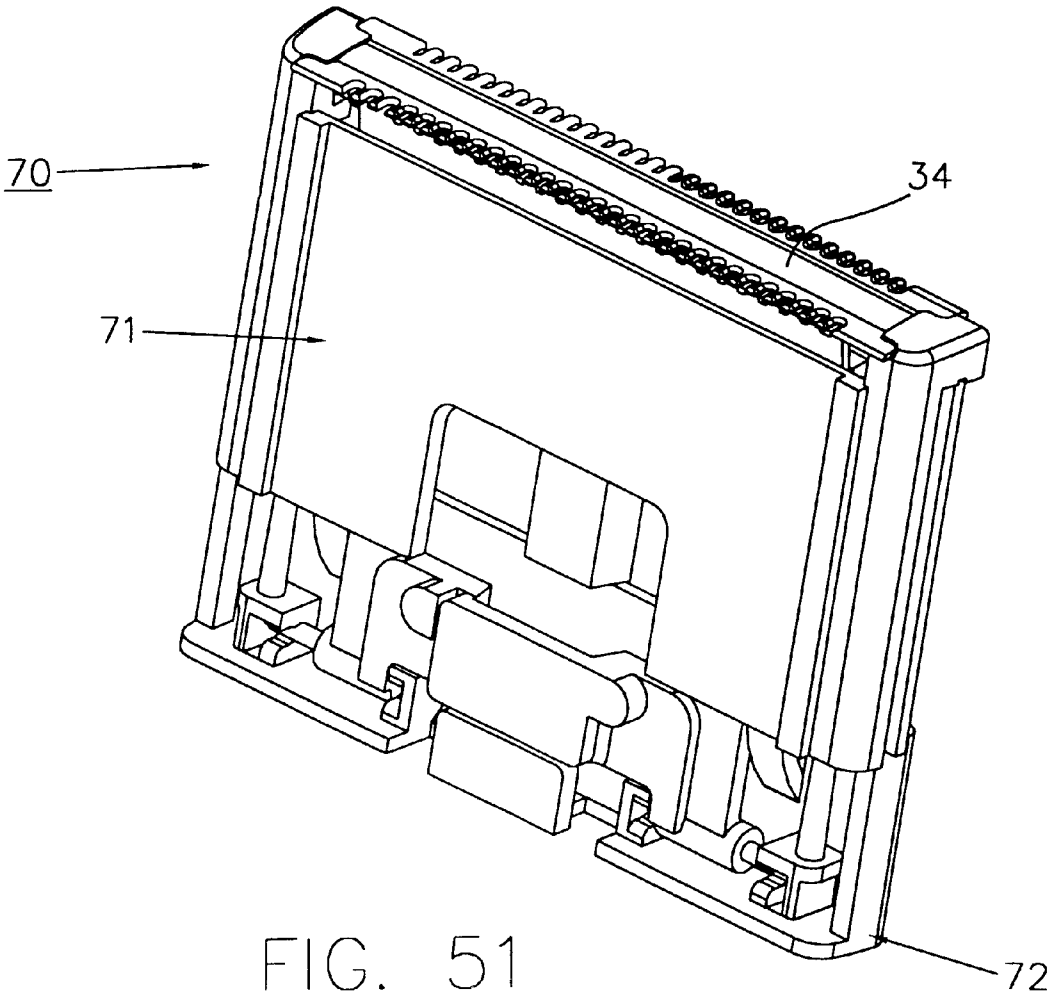
FIGS. 51 and 52 are front perspective views of a further alternate embodiment for the trimmer assembly of the present invention for mounting in the shaver system of FIG. 26.

In the first alternate construction, best seen in FIGS. 32, 46 and 47, arm members 104 and 105 are pivotally mounted on rod 125. In addition, separate torsion springs are mounted on rod 125, independently controlling and biasing pivot arms 104 and 105 in the desired direction. Alternatively, leaf spring 129 can be employed to provide the desired biasing force.

Furthermore, pivot arm 105 incorporates an elongated shaft 126 which comprises a terminating end 127 having a ratchet -like construction formed therein. Finally, pivot arm 104 comprises tab members cooperatively associated with terminating end 127 of shaft 126 of pivot arm 105.

By employing this construction, the movement of end 31 of activation switch 30 causes elongated pin 101 of switch 30 to move rearwardly, into engagement with pivot arm 104. This movement causes pivot arm 104 to be moved rearwardly, disengaging pivot arm 104 from locked interengagement with either ledge 106 or 108. In addition, due to the sloping, ratchet construction of terminating end 127 of shaft 126 of pivot arm 105, pivot arm 104 is able to move independently of pivot arm 105 with the locking tab thereof merely advancing along the sloped surfaces of terminating end 127.

By constructing cartridge 70 with pivot arm 104 which is capable of independent movement, pivot arm 104 is able to be disengaged from ledge 106 without affecting the movement of pivot arm 105. As result, movement of end 31 of switch 30 causes housing member 71 to move from the first, stored position directly into the second, intercept position, with pivot arms 104 and 105 being brought into locking engagement with ledges 107 and 108.

Using the construction detailed above, pivot arm 105 is not capable of independent movement. Instead, any activation of pivot arm 105 simultaneously causes pivot arm 104 to be moved therewith. As detailed above, since terminating end 127 of shaft 126 of pivot arm 105 incorporates a ratchet construction, which is engaged with a locking tab formed on pivot arm 104, any movement of pivot arm 105 causes pivot arm 104 to move simultaneously therewith about rod 125.

Whenever a user wishes to have cartridge 70 moved into the fully raised, hair trimming position, end 32 of switch 30 is pressed. This movement causes longitudinally extending pin 102 to move rearwardly, into engagement with pivot arm 105. The corresponding movement of pivot arm 105 causes pivot arm 105 to be disengaged from ledge 107. However, since this movement also causes pivot arm 104 to simultaneously move therewith, disengagement from ledges 106 and 108 also results from movement of end 32 of activation switch 30. As a result, regardless of cartridge 70 being in its first, stored position or in its second, intercept position, movement of end 32 of activation switch 30 causes housing member 71 to be moved directly into the third, fully raised position.

Figure 52:
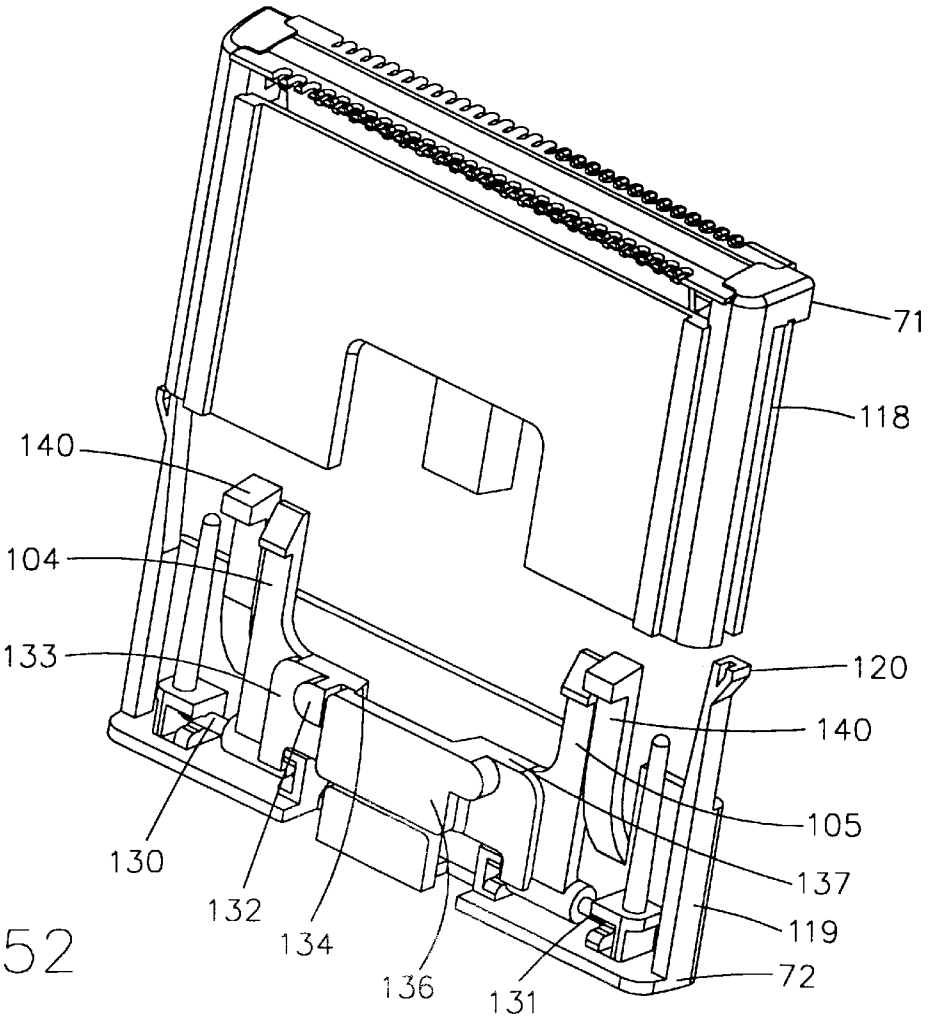
Figure 53:
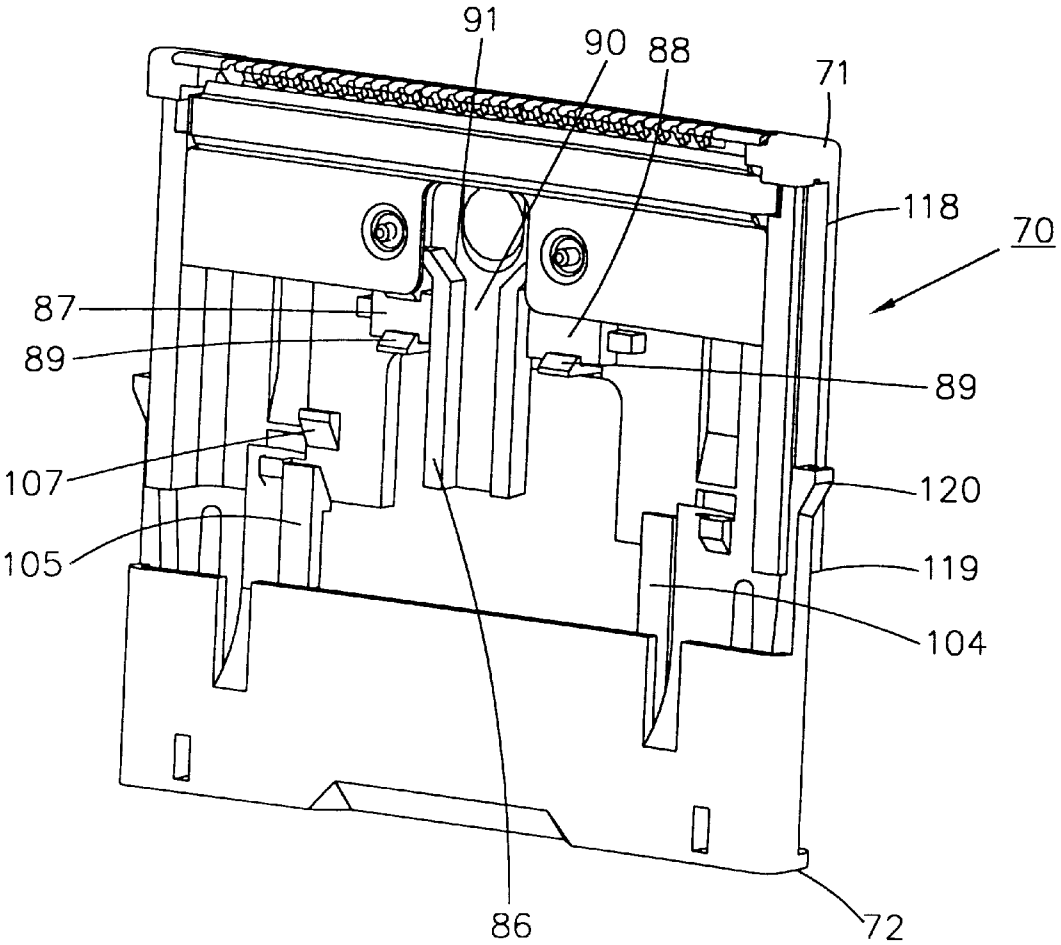
FIGS. 53 and 54 are rear perspective views of the trimmer assembly of FIG. 51 depicting the various components incorporated therein.
Figure 54:
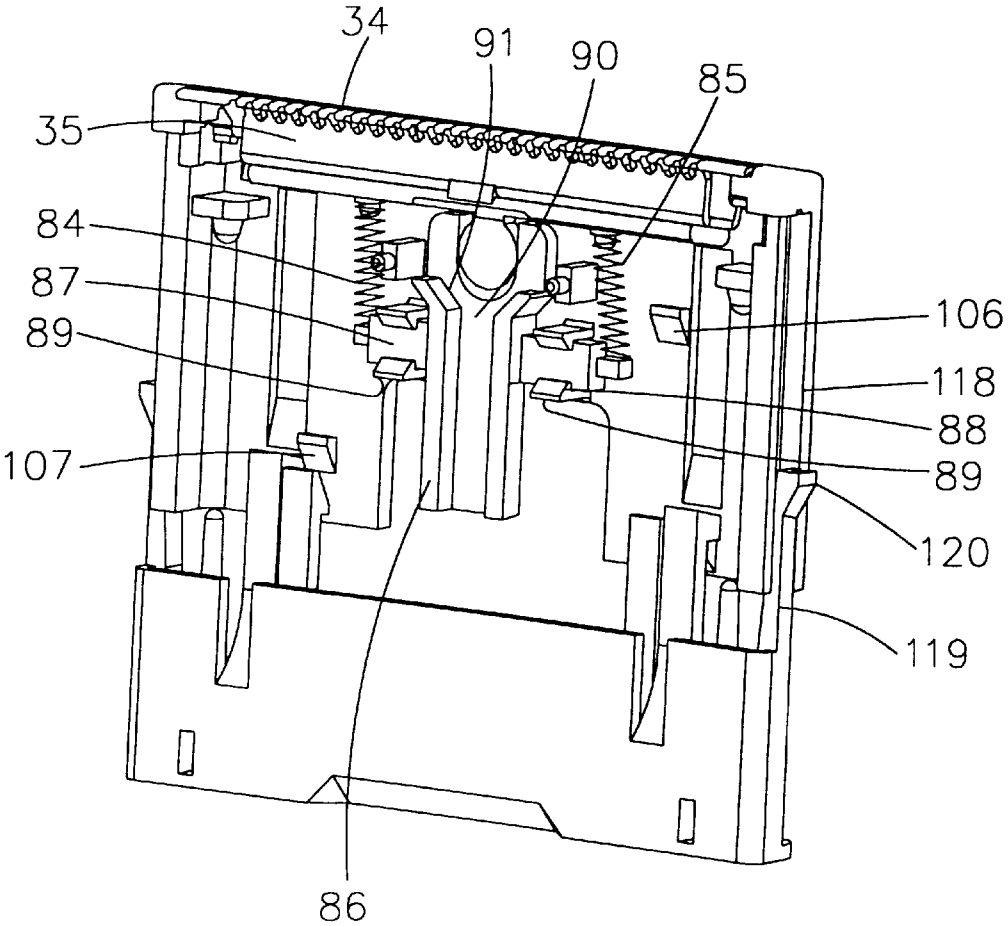

In FIG. 52, the alternate construction for providing the desired independent movement of pivot arms 104 and 105 is fully depicted. In this embodiment, pivot arm 104 is supportingly mounted for movement on elongated rod 130, with which a torsion spring is associated for maintaining pivot arm 104 with the desired biasing forces. Similarly, pivot arm 105 is mounted on an elongated rod 131 which is also associated with a torsion spring for maintaining pivot arm 105 with the desired biasing force.

In addition, as clearly shown in FIG. 52, pivot arm 104 incorporates a raised boss 132 extending from plate 133 attached to pivot arm 104. In addition, pivot arm 104 incorporates an extension zone 134 extending beyond boss 132 of plate 133.

In the preferred construction of this embodiment of pivot arm 105, pivot arm 105 comprises an elongated enlarged plate member 136 which is inter-connected to arm 105 by generally L-shaped connector 137. As depicted, plate member 136 terminates directly adjacent boss 132 of pivot arm 104 with a portion thereof being in overlying, contacting engagement with extension zone 134.

By employing this construction, movement of end 31 of activation switch 30 causes pin 101 to move rearwardly, into engagement with boss 132 of pivot arm 104. Since pivot arm 104 is completely independent in its operation, pivot arm 104 is free to move rearwardly in response to the activation of switch 30 about rod 130 against the spring biasing forces acting thereon.

Whenever end 32 of switch 30 is activated, pin 102 contacts the surface of plate member 136 causing pivot arm 105 to move rearwardly about rod 131, against the spring biasing forces acting thereon. However, due to the construction of plate member 136, movement of pivot arm 105 causes the overlapping edge of plate member 136 which is engaged with extension zone 134 of pivot arm 104 to be captured therewith, causing pivot arm 104 to simultaneously move with pivot arm 105. In this way, the desired simultaneous movement of both pivot arms 104 and 105 is attained in response to the movement of end 32 of switch 30.

The principal elements incorporated into the embodiment of cartridge 70 shown in FIGS. 51–55 are substantially identical to the features incorporated in the alternate embodiment of cartridge 70 as fully detailed above. However, in addition to the controlled movement of pivot arms 104 and 105, this alternate embodiment may also incorporate an alternate construction for providing the third, fully raised position.

As depicted, housing member 71 incorporates an elongated slot 118 formed in side edges 79 and 80. However, in this embodiment, elongated slot 118 is open ended, with a lever 119 and locking tab 120 freely sliding through slot 118, without having a terminating end position. By employing this construction, housing member 71 can be easily removed from housing member 72.

In order to provide the desired securement of housing member 71 in its fully raised, trim position, locking arm 140 is employed. As depicted, locking arm 140 extends from housing member 72 and comprises a construction for engaging with accommodating recesses 141 formed in housing member 71. In this way, the desired locked engagement of housing member 71 in its fully raised position is attained.

In the preferred construction, if desired, trimmer assembly 26 is constructed with forward facing cutting teeth 36 and rear facing cutting teeth 37 having a particular configuration for providing a specifically desired function, in order to optimize the efficacy of the present invention. As shown in FIG. 56, trimmer assembly 26 comprises fixed, immovable cutting blade 34 and movable cutting blade element 35 cooperatively associated with blade element 34 for providing the desired hair cutting action. In the preferred construction, the cutting surfaces of blade element 34 and cutting surfaces of blade element 35, both of which cooperate to form a forward facing cutting zone, are constructed with a substantially square shaped configuration. This configuration allows the edges of blade element 34 and blade element 35 to be positioned close to the hair near the skin which is to be cut. As a result, optimum performance is realized.

In the preferred construction of the rear facing cutting zone, the cutting surfaces of blade element 34 are constructed for optimizing comfortable contact between the top of blade element 34 and the skin surface by providing a smooth, radius curve in teeth 36 forming the cutting zone of blade element 34. In this way, the surface of blade element 34 is able to cut the hair fibers in a smooth comfortable manner to a length which is equal to the thickness of blade element 34. In this regard, blade element 34 is constructed with a thickness specifically configured for cooperating with apertured foils 24, providing a cutting action which leaves the length of the hair fibers at the optimum length for being cut by apertured foils 24 and cutting blade assemblies 28.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

THE CLAIMS

Having described my invention, what I claim as new and desire to secure by Letters Patent is:

1. An electric dry shaver for providing improved cutting of long hair and short hair comprising:

A. a housing comprising a trimmer receiving and holding zone formed therein;

B. at least one arcuately curved, apertured foil member removably mounted to the housing;

C. at feast one cutting blade assembly securely mounted with the housing for reciprocating movement relative thereto and cooperatively associated with said arcuately curved foil member for contacting engagement with one surface of said foil member;

D. a trimmer assembly a. mounted to the receiving and holding zone of the housing for cooperative association with the apertured foil member, b. incorporating cutting blades for providing cutting of hair fibers, c. adjustably movable relative to the apertured foil member between three alternate positions, and d. responsive to the movement of an activation switch for being selectively movable from a first stored position, wherein the cutting blades are below the apertured foil member, directly into either a second intercept position, wherein the cutting blades are co-extensively aligned with the apertured foil member, or a third trim position, wherein the cutting blades are spaced above the apertured foil member;

E. an activation switch controllably interconnected with the trimmer assembly for initiation of movement of the trimmer assembly into its alternate positions, said switch having three alternate positions and being;

a. movable from a central position in opposite directions into two alternate positions, and b. spring biased to return to its central position after movement into either of its alternate positions; and F. a movement control system cooperatively associated with the activation switch for controllably moving the trimmer assembly from its first position to its second position in response to the movement of the activation switch from its central position in a first direction and controllably moving the trimmer assembly from its first position to its third position in response to the movement of the activation switch from its central position in a second direction and comprising a. an elongated, generally, rectangular shaped, recessed zone formed on an outside surface of the trimmer assembly, said recessed zone comprising 1. a ledge centrally positioned, extending from said recessed zone near the upper end thereof, and 2. an elongated ridge extending from said recessed zone near the lower end thereof, vertically below said ledge, and comprising an elongated length extending to one side of said recessed zone; and b. a lever member incorporating a position locking pin and being controllably connected to said activation switch for moving in response to the movement to the activation switch, whereby the locking pin is engageable and disengageable with the ledge and the ridge of said recessed zone for controlling the movement of the trimmer assembly;

whereby a shaver system is obtained which is capable of enabling users to select a desired position for the trimmer assembly and actively control the movement of the trimmer assembly directly into the desired location.

2. An electric dry shaver for providing improved cutting of long hair and short hair comprising:

A. a housing comprising a trimmer receiving and holding zone formed therein;

B. at least one arcuately curved, apertured foil member removably mounted to the housing;

C. at least one cutting blade assembly securely mounted with the housing for reciprocating movement relative thereto and cooperatively associated with said arcuately curved foil member for contacting engagement with one surface of said foil member;

D. a trimmer assembly a. mounted to the receiving and holding zone of the housing for cooperative association with the apertured foil member, b. incorporating cutting blades for providing cutting of hair fibers, c. adjustably movable relative to the apertured foil member between three alternate positions, d. responsive to the movement of an activation switch for being selectively movable from a first stored position, wherein the cutting blades are below the apertured foil member, directly into either a second intercept position, wherein the cutting blades are co-extensively aligned with the apertured foil member, or a third trim position, wherein the cutting blades are spaced above the apertured foil member; and e. comprising a first housing member and a second housing member cooperatively associated with the first housing member and movable relation thereto;

E. an activation switch controllably interconnected with the trimmer assembly for initiation of movement of the trimmer assembly into its alternate positions, said switch having three alternate positions and being:

a. movable from a central position in opposite directions into two alternate positions, and b. spring biased to return to its central position after movement into either of its alternate positions; and F. a movement control system cooperatively associated with the activation switch for controllably moving the trimmer assembly from its first position to its second position in response to the movement of the activation switch from its central position in a first direction and controllably moving the trimmer assembly from its first position to its third position in response to the movement of the activation switch from its central position in a second direction and comprising a. a first ledge on an inside surface of said second housing member near an upper end thereof and constructed for defining the first position of the trimmer assembly, b. a second ledge formed on the inside surface of said second housing member below said first ledge and vertically aligned therewith, and c. a third ledge formed on the inside surface of said second housing member, horizontally aligned with the second ledge, and defining the second position of the trimmer assembly in combination with the second ledge;

whereby a shaver system is obtained which is capable of enabling users to select a desired position for the trimmer assembly and actively control the movement of the trimmer assembly directly into the desired location.

3. An electric dry shaver for providing improved cutting of long hair and short hair comprising:

A. a housing comprising a trimmer receiving and holding zone formed therein;

B. at least one arcuately curved, apertured foil member removably mounted to the housing;

C. at least one cutting blade assembly securely mounted with the housing for reciprocating movement relative thereto and cooperatively associated with said arcuately curved foil member for contacting engagement with one surface of said foil member;

D. a trimmer assembly a. mounted to the receiving and holding zone of the housing for cooperative association with the apertured foil member, b. incorporating cutting blades for providing cutting of hair fibers, c. adjustably movable relative to the apertured foil member between three alternate positions, and d. responsive to the movement of an activation switch for being selectively movable from a first stored position, wherein the cutting blades are below the apertured foil member, directly into either a second intercept position, wherein the cutting blades are co-extensively aligned with the apertured foil member, or a third trim position, wherein the cutting blades are spaced above the apertured foil member;

E. an activation switch controllably interconnected with the trimmer assembly for initiation of movement of the trimmer assembly into its alternate positions, said switch having three alternate positions and being;

a. movable from a central position in opposite directions into two alternate positions, and b. spring biased to return to its central position after movement into either of its alternate positions; and F. a movement control system cooperatively associated with the activation switch for controllably moving the trimmer assembly from its first position to its second position in response to the movement of the activation switch from its central position in a first direction and controllably moving the trimmer assembly from its first position to its third position in response to the movement of the activation switch from its central position in a second direction;

whereby a shaver system is obtained which is capable of enabling users to select a desired position for the trimmer assembly and actively control the movement of the trimmer assembly directly into the desired location.

4. The electric dry shaver defined in claim 3, wherein the movement control system is defined as comprising, a. an elongated, generally, rectangular shaped, recessed zone formed on an outside surface of the trimmer assembly, said recessed zone comprising 1. a ledge centrally positioned, extending from said recessed zone near the upper end thereof, and 2. an elongated ridge extending from said recessed zone near the lower end thereof, vertically below said ledge, and comprising an elongated length extending to one side of said recessed zone; and b. a lever member incorporating a position locking pin and being controllably connected to said activation switch for moving in response to the movement to the activation switch, whereby the locking pin is engageable and disengageable with the ledge and the ridge of said recessed zone for controlling the movement of the trimmer assembly.

5. The electric dry shaver defined in claim 4, wherein said activation switch comprises an elongated arm member engageable with the lever member of the movement control system for causing the lever member to move in response to movement of the activation switch and to return to its original position in response to movement of the activation switch to its central position, whereby said lever member and its associative locking pin are automatically self-centering.

6. The electric dry shaver defined in claim 3, wherein the trimmer assembly is further defined as comprising a first housing member and a second housing member cooperatively associated with the first housing member and constructed for being movable relative thereto, and said movement control system of said trimmer assembly is defined as comprising;

a. a first ledge formed on an inside surface of said second housing member near an upper end thereof and constructed for defining the first position of the trimmer assembly, b. a second ledge formed on the inside surface of said second housing member below said first ledge and vertically aligned therewith, and c. a third ledge formed on the inside surface of said second housing member, horizontally aligned with the second ledge, and defining the second position of the trimmer assembly in combination with the second ledge.

7. The electric dry shaver defined in claim 6, wherein said movement control system further comprises a pair of finger members movably mounted between said first housing member and said second housing member, and comprising hook means formed at the terminating edges thereof for cooperative, locking engagement with the ledges of the second housing member.

8. An electric dry shaver for providing improved cutting of long hair and short hair comprising:

A. a housing;

B. at least one arcuately curved, apertured foil member removably mounted to the housing;

C. at least one cutting blade assembly securely mounted with the housing for reciprocating movement relative thereto and cooperatively associated with said arcuately curved foil member for contacting engagement with one surface of said foil member;

D. a trimmer assembly a. mounted to the housing for cooperative association with the apertured foil member, b. incorporating cutting blades for providing cutting of hair fibers, c. adjustably movable relative to the apertured foil member between three alternate positions, and d. responsive to the movement of an actuating switch for being 1. selectively movable from a first stored position, wherein the cutting blades are below the apertured foil member, directly into a second intercept position, wherein the cutting blades are co-extensively aligned with the apertured foil member, and 2. selectively movable from the first stored position directly into a third trim position, wherein the cutting blades are spaced above the apertured foil member, said movement being achieved automatically by movement in a single, continuous, non-stop travel path; and E. an activation switch comprising three alternate positions and controllably interconnected with the trimmer assembly for controlling the movement of the trimmer assembly into its alternate positions;

whereby a shaver system is obtained which is capable of enabling users to select a desired position for the trimmer assembly and actively control the movement of the trimmer assembly directly into the desired location.

9. An electric dry shaver for providing improved cutting of long hair and short hair comprising:

A. a housing;

B. at least one arcuately curved, apertured foil member removably mounted to the housing;

C. at least one cutting blade assembly securely mounted with the housing for reciprocating movement relative thereto and cooperatively associated with said arcuately curved foil member for contacting engagement with one surface of said foil member;

D. a trimmer assembly a. mounted to the housing for cooperative association with the apertured foil member, b. incorporating cutting blades for providing cutting of hair fibers, c. adjustably movable relative to the apertured foil member between three alternate positions, and d. responsive to the movement of an actuating switch for being selectively movable from a first stored position, wherein the cutting blades are below the apertured foil member, directly into either a second intercept position, wherein the cutting blades are co-extensively aligned with the apertured foil member, or a third trim position, wherein the cutting blades are spaced above the apertured foil member; and E. an activation switch comprising three alternate positions and controllably interconnected with the trimmer assembly for controlling the movement of the trimmer assembly into its alternate positions and being a. movable from a central position in opposite directions into two alternate positions, and b. spring biased to return to its central position after movement into either of its alternate positions whereby a shaver system is obtained which is capable of enabling users to select a desired position for the trimmer assembly and actively control the movement of the trimmer assembly directly into the desired location.

10. The electric dry shaver defined in claim 9, wherein said housing is further defined as comprising a trimmer assembly receiving and holding zone integrally formed therein, and said trimmer assembly is further defined as comprising a housing member mounted in said receiving and holding zone for movement relative thereto.

11. The electric dry shaver defined in claim 10, wherein said trimmer assembly is further defined as cooperating with spring means continuously biasing the trimmer assembly upwardly and comprising a movement control system cooperatively associated with the activation switch for controllably moving the trimmer assembly from its first position to its second position in response to the movement of the activation switch from its central position in a first direction and controllably moving the trimmer assembly from its first position to its third position in response to the movement of the activation switch from its central position in a second direction.

12. The electric dry shaver defined in claim 11, wherein the movement control system of said trimmer assembly is further defined as being cooperatively associated with the activation switch for moving the trimmer assembly from its second position to its third position in response to the movement of the activation switch from its first position to its third position.

13. The electric dry shaver defined in claim 12, wherein the housing member of the trimmer assembly is further defined as being arcuately curved and the receiving and holding zone of the shaver is arcuately curved for receiving and retaining the housing member therein, whereby movement of said trimmer assembly relative to the receiving zone is along the arcuate path defined thereby, thereby placing the cutting blades of the trimmer assembly in close, juxtaposed, spaced relationship to the apertured foil member.

14. The electric dry shaver defined in claim 11, wherein the movement control system is defined as comprising, a. an elongated, generally, rectangular shaped, recessed zone formed on the housing member of the trimmer assembly, said recessed zone comprising
   1. a ledge centrally positioned, extending from said recessed zone near the upper end thereof, and
   2. an elongated ridge extending from said recessed zone near the lower end thereof, vertically below said ledge, and comprising an elongated length extending to one side of said recessed zone; and b. a lever member incorporating a position locking pin and being controllably connected to said activation switch for moving in response to the movement to the activation switch, whereby the locking pin is engageable and disengageable with the ledge and the ridge of said recessed zone for controlling the movement of the trimmer assembly.

15. The electric dry shaver defined in claim 14, wherein said activation switch comprises an elongated arm member engageable with the lever member of the movement control system for causing the lever member to move in response to movement of the activation switch and to return to its original position in response to movement of the activation switch to its central position, whereby said lever member and its associative locking pin are automatically self-centering.

16. The electric dry shaver defined in claim 11, wherein the trimmer assembly is further defined as comprising a first housing member and a second housing member cooperatively associated with the first housing member and constructed for being movable relative thereto, and said movement control system of said trimmer assembly is defined as comprising;

a. a first ledge formed on an inside surface of said second housing member near an upper end thereof and constructed for defining the first position of the trimmer assembly, b. a second ledge formed on the inside surface of said second housing member below said first ledge and vertically aligned therewith, and c. a third ledge formed on the inside surface of said second housing member, horizontally aligned with the second ledge, and defining the second position of the trimmer assembly in combination with the second ledge.

17. The electric dry shaver defined in claim 16, wherein said movement control system further comprises a pair of first and second finger members movably mounted between said first housing member and said second housing member, and comprising hook means formed at the terminating edges thereof for cooperative, locking engagement with the ledges of the second housing member.

18. The electric dry shaver defined in claim 17, wherein said finger members are spring biased for maintaining engagement with the ledges of the second housing member and responsive to an activation force for being disengaged from said ledges.

19. The electric dry shaver defined in claim 18, wherein said movement control system further comprises holding means cooperatively associated with the first housing member and the second housing member for maintaining the housing members in the third, fully extended position whenever the finger members are disengaged from the ledges.

20. The electric dry shaver defined in claim 19, wherein said activation switch comprises elongated, rearwardly extending pin members positioned for contacting the finger members and controllably moving the finger members in response to movement of the activation switch.

21. The electric dry shaver defined in claim 20, wherein the first finger member is constructed for independent movement in response to movement of the activation switch in its first direction and both the first finger member and the second finger member are constructed for simultaneous movement in response to movement of the activation switch in its second direction.

22. The electric dry shaver defined in claim 21, wherein the second finger member incorporates an enlarged plate integrally attached thereto and constructed for overlaying engagement with the first finger member, thereby assuring movement of the first finger member simultaneously with movement of the second finger member.

23. The electric dry shaver defined in claim 21, wherein each of the ledges is further defined as comprising a substantially flat top surface and a sloping, ramped side surface extending from the terminating edge of the top surface to the inside surface of the second housing member, thereby providing camming engagement with movable arm members when the trimmer assembly is returned from the third position or second position to its first position.

24. The electric dry shaver defined in claim 23, wherein said trimmer assembly is returned to its original position by manual movement of the housing member.

25. The electric dry shaver defined in claim 23, wherein a slider plate incorporates an elongated drive pin engaging channel constructed for receiving the drive pin and moving the slider plate in response to movement of the drive pin, also incorporating an enlarged open zone at one end thereof, constructed for cooperating with the drive pin when the trimmer assembly is in its first, stored position, whereby movement of the drive pin does not effect movement of the cutting blades.

26. The electric dry shaver defined in claim 11, wherein said trimmer assembly is further defined as comprising a first, cutting blade fixedly mounted to the housing member and a second cutting blade movably mounted to the housing member in cooperative, sliding, interengaged relationship with the first cutting blade, said second cutting blade being controllably movable by a slider plate constructed for being responsive to the movement of a motor controlled drive pin.

27. The electric dry shaver defined in claim 11, wherein said housing member is capable of vertical movement when in the second, intercept position, thereby providing floating, movable flexibility to the cutting blades thereof.

* * * * *